US011351659B2

(12) United States Patent
Chen

(10) Patent No.: US 11,351,659 B2
(45) Date of Patent: Jun. 7, 2022

(54) RATCHETING OPEN JAW WRENCH

(71) Applicant: JS Products, Inc., Las Vegas, NV (US)

(72) Inventor: Chungeng Chen, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 597 days.

(21) Appl. No.: 16/373,926

(22) Filed: Apr. 3, 2019

(65) Prior Publication Data

US 2020/0316756 A1 Oct. 8, 2020

(51) Int. Cl.

*B25B 13/22* (2006.01)
*B25B 13/46* (2006.01)
*B25B 13/14* (2006.01)

(52) U.S. Cl.

CPC ..... *B25B 13/22* (2013.01); *B25B 13/14* (2013.01); *B25B 13/46* (2013.01)

(58) Field of Classification Search

CPC ..... B25B 13/14; B25B 13/22; B25B 13/02; B25B 13/08; B25B 13/46

See application file for complete search history.

(56) References Cited

U.S. PATENT DOCUMENTS 1,048,380 A * 12/1912 Youngquist ..... B25B 13/46 81/179
1,506,362 A * 8/1924 Carman ..... B25B 13/18 81/361
2,574,834 A * 11/1951 Leonard ..... B25B 13/14 81/129
2,795,160 A * 6/1957 Blasdell ..... B25B 13/46 81/179
4,794,824 A * 1/1989 Chapman ..... B25B 7/04 81/131
5,048,380 A * 9/1991 Caldwell ..... B25B 13/46 81/165
5,768,958 A * 6/1998 Gamble ..... B25B 13/46 81/179
5,890,404 A * 4/1999 Stojanowski ..... B25B 13/46 81/165
6,637,300 B2 * 10/2003 Wu ..... B25B 13/14 81/170
8,056,446 B1 * 11/2011 Wheeler ..... B25B 7/04 81/58
8,347,764 B2 1/2013 Tuan-Mu et al.
8,631,725 B2 1/2014 Tuan-Mu
8,978,524 B2 3/2015 Tuan-Mu et al.
2004/0031359 A1 * 2/2004 Kady ..... B25B 13/46 81/179
2009/0277311 A1 * 11/2009 Alford ..... B25B 13/22 81/355

(Continued)

*Primary Examiner* — David B. Thomas
(74) *Attorney, Agent, or Firm* — Weide & Miller, Ltd.

(57) ABSTRACT

A ratcheting wrench includes a first jaw with a first jaw insert configured to move relative to the first jaw and a first spring configured to bias the first jaw insert in a first direction. The wrench also includes a second jaw with a second jaw insert configured to move relative to the second jaw and a second spring configured to bias the second jaw insert in a second direction opposite the first direction. When the first jaw insert moves relative to the first jaw and the second jaw insert moves relative to the second jaw, a space between the first jaw and the second jaw increases. This allows the jaws of the wrench to slip over corners of a fastener to achieve a ratcheting effect.

17 Claims, 18 Drawing Sheets

(56) References Cited

U.S. PATENT DOCUMENTS

| | | | | |
|---|---|---|---|---|
| 2015/0266167 | A1* | 9/2015 | Robinson | B25B 13/46 81/60 |
| 2016/0039074 | A1* | 2/2016 | Lee | B25B 13/22 81/139 |
| 2016/0082575 | A1* | 3/2016 | Yu | B25B 13/46 81/58.2 |

* cited by examiner

RATCHETING OPEN JAW WRENCH

BACKGROUND

The disclosed embodiments relate to hand tools. More specifically, the disclosed embodiments relate to wrenches and adjustable wrenches having ratcheting features.

A wrench is a common tool widely used to tighten and loosen fasteners in a variety of applications. Some wrenches may be sold in sets with wrenches having jaws sized at various standard sizes. Other wrenches have adjustable jaws that allows the user to change the space between the jaws of the wrench to accommodate different sizes of fasteners using a single wrench.

Another common wrench is a socket wrench. Typically, this wrench may attach to several different sized sockets to drive a fastener. These wrenches often include a ratcheting feature that applies torque to the fastener when rotated in one direction and allow the wrench to rotate in a second opposite direction without transmitting torque to the fastener. This way, the socket does not need to be removed from the fastener while tightening or loosening the fastener.

When using such wrenches, it may sometimes be difficult to size the wrench while working in tight spaces. Further, it may be difficult to continually remove the wrench away from the fastener and find another appropriate angle relative to the fastener on which to again place the wrench onto the fastener. Further, some applications do not allow for the use of sockets due to protruding bolts or other size constraints. Thus, it would be desirable to have improved wrenches that are easily adjusted and that may provide ratcheting capabilities.

SUMMARY

Aspects of the present disclosure may be embodied as a device implemented as a laminated tool having a gearing mechanism. In some embodiments, the tool may have an elongated body comprising jaws and a handle. The jaws, in one example, include a fixed jaw and an adjustable jaw. The tool may include a worm gear coupled to the body so as to engage the adjustable jaw. The worm gear may be configured to drive the adjustable jaw toward the fixed jaw during rotation in a first direction. The tool may include a gearing mechanism coupled to the body so as to engage the worm gear via a belt. The gearing mechanism may be activated by actuation of a rocker arm. The gearing mechanism may be configured to rotate the worm gear in the first direction via the belt upon activation by compression of the rocker arm. As a result, during operation of the tool, compression of the rocker arm causes the adjustable jaw to move toward the fixed jaw.

According to other aspects of the disclosure, an adjustable, ratcheting wrench is provided comprising a fixed jaw comprising a fixed jaw insert slot and a first jaw insert. The first jaw insert includes a first flange that is disposed within the fixed jaw insert slot. The flange is configured to move within the fixed jaw insert slot. The first jaw insert also includes a first elongated hole formed in the first flange of the first jaw insert, and a first compression spring disposed in the first elongated hole.

The wrench further includes a first dowel disposed in the fixed jaw extending into the first elongated hole of the first flange. The first compression spring abuts against the first dowel to bias the first jaw insert in a first direction.

The wrench also includes an adjustable jaw having an adjustable jaw insert slot and a second jaw insert. The second jaw insert includes a second flange that is disposed within the adjustable jaw insert slot and is configured to move within the adjustable jaw insert slot. The second jaw insert further includes a second elongated hole formed in the second flange of the second jaw insert, and a second compression spring disposed in the second elongated hole.

The wrench also includes a second dowel disposed in the adjustable jaw extending into the second elongated hole of the second flange. The second compression spring abuts against the second dowel to bias the second jaw insert in a second direction opposite the first direction.

A handle portion is connected to the fixed jaw and the adjustable jaw. The handle portion includes a grip, a rocker arm extending from the grip, and a gearing mechanism. The gearing mechanism is disposed within the handle portion and is actuated by the rocker arm. The gearing mechanism is linked to the adjustable jaw to move the adjustable jaw towards the fixed jaw. The handle portion also has a push button configured to release the adjustable jaw from at least a portion of the gearing mechanism to allow the adjustable jaw to move away from the fixed jaw.

In some embodiments a third direction defines the movement of the adjustable jaw towards and away from the fixed jaw and the first and second direction are oblique relative to the third direction. When the fixed and adjustable jaws are in contact with a fastener and the handle portion is torqued in a first rotational direction, the first dowel and the second dowel prevent the first jaw insert and the second jaw insert from moving, thereby transferring torque to the fastener. When the fixed and adjustable jaws are in contact with the fastener and the handle portion is torqued in a second rotational direction opposite the first rotational direction, a reaction force from the fastener causes the first jaw insert and the second jaw insert to slide within the fixed jaw insert slot and the second jaw insert slot in the second direction and the first direction respectively, thereby allowing the fixed and adjustable jaws to slip over corners of the fasteners.

According to one embodiment, the adjustable jaw comprises teeth and the gearing mechanism comprises a worm gear configured to drive the adjustable jaw via the teeth. The worm gear is connected to a pinion gear via a belt, the pinion gear is driven by center gear connected to a one-way clutch, and the one-way clutch is driven by the actuation of the rocker arm.

The push button may be configured to release the center gear from the one-way clutch allowing a coil spring to drive the center gear. The adjustable jaw thus moves towards the fixed jaw when the center gear is connected to the one-way clutch, and the adjustable jaw moves away from the fixed jaw when the center gear is driven by the coil spring.

According to additional embodiments of the disclosure, a ratcheting wrench comprises a first jaw comprising a first jaw insert configured to move relative to the first jaw, and a first spring configured to bias the first jaw insert in a first direction. The wrench further comprises a second jaw comprising a second jaw insert configured to move relative to the second jaw, and a second spring configured to bias the second jaw insert in a second direction opposite the first direction. When the first jaw insert moves relative to the first jaw and the second jaw insert moves relative to the second jaw, a space between the first jaw and the second jaw increases.

In some embodiments, the first jaw is a fixed jaw, and the second jaw is an adjustable jaw that is configured to move towards and away from the fixed jaw. A worm gear may be configured to drive the adjustable jaw towards and away from the fixed jaw.

The wrench may include a handle portion connected to the first jaw and the second jaw. The handle portion comprises a grip, a rocker arm extending from the grip, and a gearing mechanism disposed within the handle portion. The gearing mechanism may be actuated by the rocker arm and may be linked to the second jaw to move the second jaw towards the first jaw. The handle portion may further comprise a push button configured to release the second jaw from at least a portion of the gearing mechanism to allow the second jaw to move away from the first jaw.

In some embodiments, the second jaw comprises teeth and the gearing mechanism comprises a worm gear configured to drive the second jaw via the teeth. The worm gear may be connected to a pinion gear via a belt, the pinion gear may be driven by center gear connected to a one-way clutch, and the one-way clutch may be driven by the actuation of the rocker arm.

In some embodiments, the push button releases the center gear from the one-way clutch allowing a coil spring to drive the center gear. The second jaw moves towards the first jaw when the center gear is driven by the one-way clutch, and the second jaw moves away from the first jaw when the center gear is driven by the coil spring.

According to other embodiments, the first jaw comprises a first jaw insert slot. The first jaw insert comprises a first flange, and the first flange is disposed within the first jaw insert slot. Similarly, the second jaw comprises a second jaw insert slot. The second jaw insert comprises a second flange, and the second flange is disposed within the second jaw insert slot.

The first flange comprises a first elongated hole formed in the first flange of the first jaw insert, and the first spring is a compression spring disposed within the first elongated hole. Likewise, the second flange comprises a second elongated hole formed in the second flange of the second jaw insert, and the second spring is a compression spring disposed within the second elongated hole.

A first dowel may be disposed in the first jaw extending into the first elongated hole of the first flange. The first spring abuts against the first dowel to bias the first jaw insert in the first direction. A second dowel may be disposed in the second jaw extending into the second elongated hole of the second flange. The second spring abuts against the second dowel to bias the second jaw insert in the second direction.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

The description of elements in each figure may refer to elements of one or more proceeding figures. Like numbers refer to like elements in the figures, including alternate embodiments of like elements.

FIGS. 1-6 illustrate various views of a tool and various components thereof in accordance with embodiments of the present disclosure.

Figure 1:
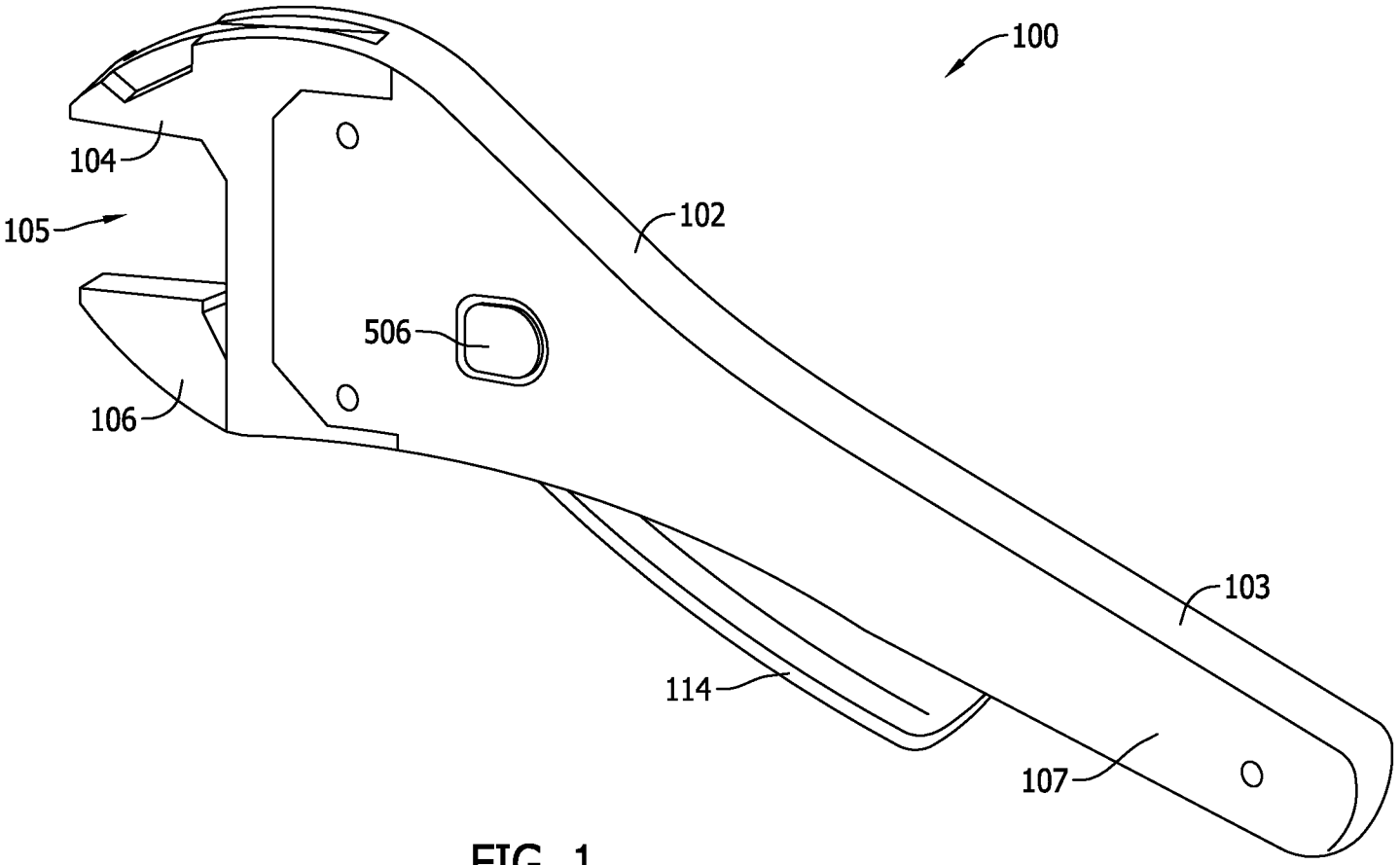
FIG. 1, illustrates one embodiment of a tool in accordance with embodiments of the present disclosure.

In particular, FIG. 1 illustrates one embodiment of a tool 100 in accordance with embodiments of the present disclosure. FIG. 1 provides a view of an outer appearance of the tool 100. As shown in FIG. 1, the tool 100 may include or be referred to as an adjustable wrench having a body 102 configured with a clamping jaw configuration 105. This configuration combines a fixed jaw 104 and an adjustable jaw 106 with rack-worm construction of an open-ended adjustable wrench with a set of torque transmission members that may be configured to convert an arc-swing movement of a rocker arm 114 into movement of the adjustable jaw, such as by rotational movement of a bevel gear which then drives a bevel pinion to transmit a hand torque onto a worm via a synchronous belt connection. This action is configured to move the adjustable jaw 106 toward the fixed jaw 104 to thereby provide a selectably adjustable jaw opening within a specified capacity. In this configuration, hand torque transmitted via the rocker arm 114 may reduce use of direct thumb movement of a worm gear as provided with traditional adjustable wrenches and may replace it with an ergonomic hand-squeezing motion of paddling the rocker arm 114 to close the jaws 104, 106 or depressing a push button 506 to open the jaws 104, 106.

The worm or worm drive, as will be described below in greater detail, may be fully or at least partially concealed inside the body 102 of the tool 100. The adjustable jaw movement may be controlled by the rocker arm 114, and the push button 506, which is preferably accessible at the exterior of the body 102, such as being positioned at one side thereof and near a midpoint of the body 102. Further, the entire handle or body may be wrapped by molded plastic, or stamped/forged metal, cover plates 107 and a side grip 103 to provide a comfortable grip around a periphery of the body 102. In some implementations, the side grip 103 may include a molded plastic material or rubber material for comfort. In other embodiments, the side grip 103 is formed of a metal-based material, and may be overmolded with a polymer-based material.

In some implementations, the adjustable jaw 106 refers to a movable portion of the tool 100 that contacts a fastener (not shown), such as, e.g., a bolt head. The fixed jaw 104 refers to a stationary portion of the tool 100 that also contacts the fastener. The rocker arm or paddle 114 refers to a movable portion of the handle or body 102 that transmits hand torque into a drive mechanism (as described herein) constructed within the body 102 of the tool 100. Further, the push button 506 button is configured to open the adjustable jaw 106 when the push button 506 is depressed or compressed. These and various other aspects of the disclosure are described in greater detail herein.

Figure 2A:
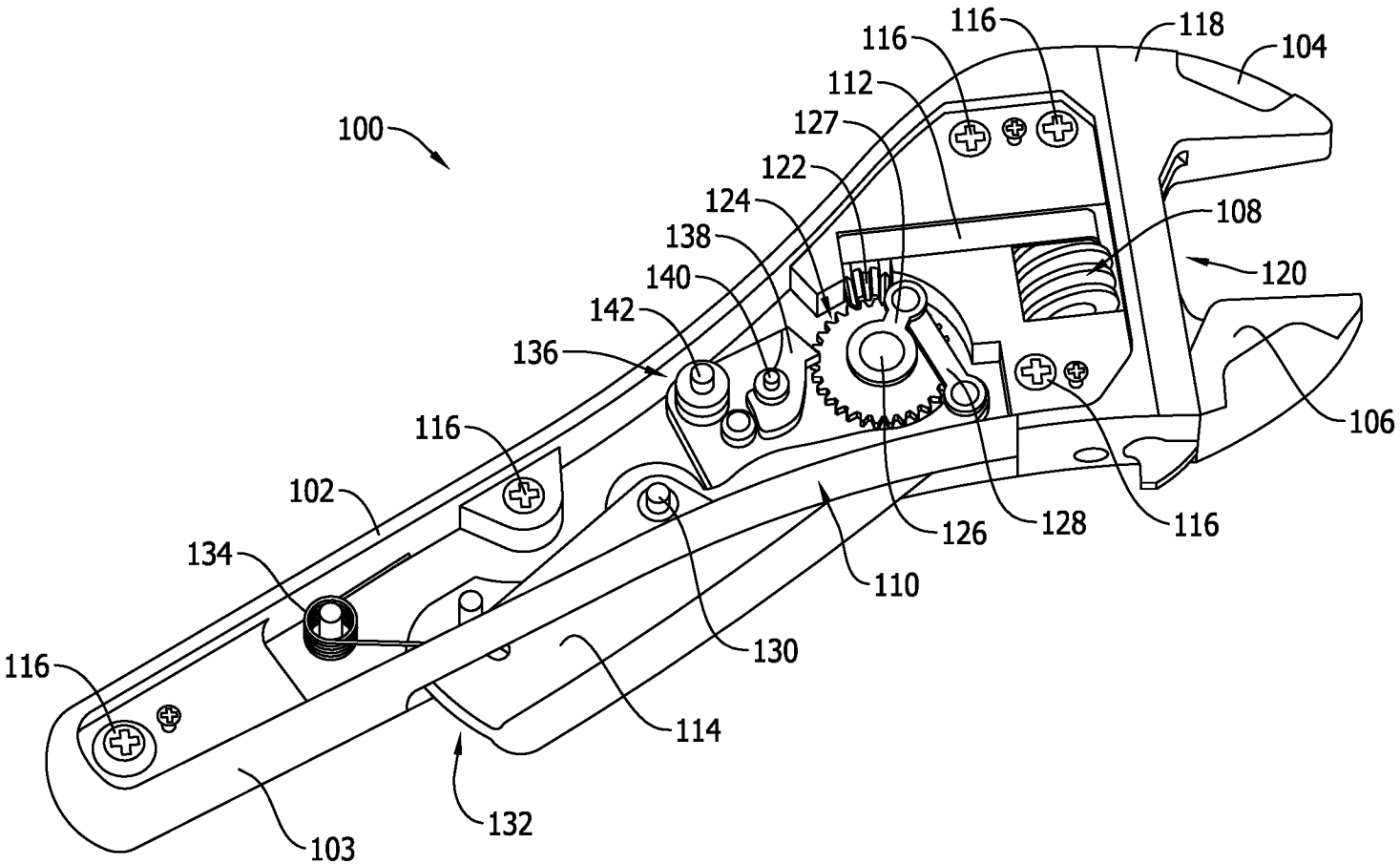
FIG. 2A and FIG. 2B illustrate schematic views of a tool in accordance with embodiments of the present disclosure.

FIG. 2A illustrates a schematic view of the tool 100 in accordance with embodiments of the present disclosure. As shown in FIG. 2A, the tool 100 may include the handle or body 102 (i.e., base, barrel, structure, chassis, frame, etc.), which may be formed with an elongated shape. In various implementations, the tool 100 may be referred to as a device or apparatus in the form of a tool having the body 102 contoured as an elongated handle of the tool 100.

The body 102 may include the fixed jaw 104 and the adjustable jaw 106. The tool 100 may include a worm drive or a worm gear 108, rotatably coupled to the body 102 so as to engage the adjustable jaw 106. The worm gear 108 may be configured to drive the adjustable jaw 106 toward the fixed jaw 104 during rotation in a first direction (i.e., first rotary direction). The tool 100 may include a gearing mechanism 110 coupled to the body 102 so as to engage the worm gear 108 via a belt 112 (e.g., a timing belt). The gearing mechanism 110 may be activated by compression of the rocker arm 114 (e.g., a paddle or articulating paddle). The gearing mechanism 110 may be configured to rotate the worm gear 108 in the first direction via the belt 112 upon activation by compression of the rocker arm 114.

In reference to FIG. 2A, the fixed jaw 104 may be part of a head assembly 118 that is coupled to the body 102 via one or more fasteners or fastening members 116, such as screw s, (e.g., sheet metal screws). In some implementations, the head assembly 118, including the fixed jaw 104, may be formed and/or integrated as part of the body 102. The head assembly 118 may include a channel 120 configured to receive the adjustable jaw 106. The adjustable jaw 106 may be coupled to body 102 via the channel 120, which may be formed as part of the head assembly 118. The adjustable jaw 106 may be configured to slidably engage the channel 120 so as to move toward the fixed jaw 104 by sliding along the channel 120. The head assembly 118 may be referred to as an adjustable clamping mechanism, wherein the fixed jaw 104 may be referred to as a first clamping member, and the adjustable jaw may be referred to as a second clamping member that may be configured as an adjustable or movable member.

Figure 3:
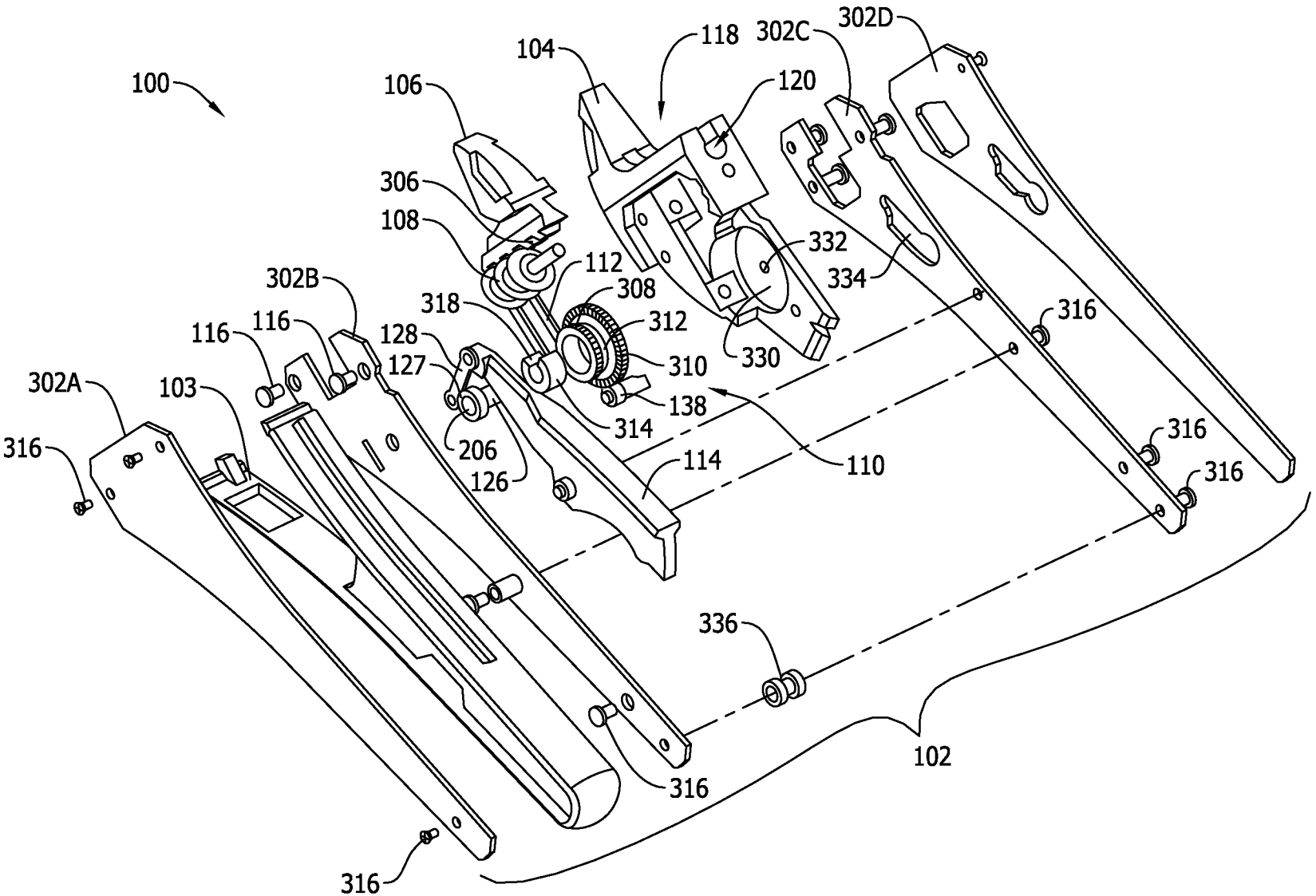
FIG. 3 illustrates an exploded view of a tool in accordance with embodiments of the present disclosure.

The worm gear 108 may be rotatably mounted within the head assembly 118 (head portion) of the body 102 proximate to the fixed jaw 104. The worm gear 108 may be configured to rotate within the head assembly 118 of the body 102 upon activation of the gearing mechanism 110 by compression of the rocker arm 114. The worm gear 108 may be configured to drive the adjustable jaw 106 toward the fixed jaw 104 during rotation by engaging one or more teeth 306 (as shown in FIG. 3) formed as part of the adjustable jaw 106. The worm gear 108 may also be referred to as a clamping gear.

The gearing mechanism 110 may include a first gear or bevel pinion 122 that is rotatably coupled to the body 102. The bevel pinion 122 may be configured to engage the worm gear 108 via the belt 112. The bevel pinion 122 may be configured to rotate the worm gear 108 in the first direction via the belt 112 upon activation of the gearing mechanism 110 by compression of the rocker arm 114. The gearing mechanism 110 may include a second gear or center bevel gear 124 rotatably coupled to the body 102 via a center shaft 126. The center bevel gear 124 may be configured to engage the bevel pinion 122, and the center bevel gear 124 may be configured to rotate the bevel pinion 122 upon activation of the gearing mechanism 110 by compression of the rocker arm 114. The bevel pinion 122 may be referred to as a driving gear.

The gearing mechanism 110 may include a connecting rod 128 and crank link or plate 127. The connecting rod 128 may be coupled to the crank plate 127, and the crank plate 127 may be coupled to the center shaft 126. In this instance, the connecting rod 128 may be coupled to the center bevel gear 124 via the crank plate 127, and the connecting rod 128 may also be coupled to the rocker arm 114. With this linkage, the connecting rod 128 may be configured to rotate the center bevel gear 124 upon activation of the gearing mechanism 110 by compression of the rocker arm 114. Further, the rocker arm 114 may be coupled to the body 102 at a pivot point 130, and as such, the rocker arm 114 may be configured to pivot (e.g., rock back and forth) about the pivot point 130. As shown in FIG. 2A, one end 132 of the rocker arm 114 may be biased with a spring or paddle spring 134 that is coupled to the body 102. The rocker arm 114 may be referred to as a paddle or articulating paddle. As a user activates the rocker arm 114 by, for example, squeezing the rocker arm 114, the squeezing motion is transferred about the pivot point 130 to the connecting rod 128. The connecting rod 128, subsequently, moves in an opposite direction as the squeezing motion, and causes the crank plate 127 to rotate. As such, a substantially linear motion by the user (i.e., squeezing the rocker arm 114) is translated into a circular motion by the crank plate 127.

The gearing mechanism 110 may include a ratchet assembly 136 having a pawl 138 mounted to the body 102. In this instance, the pawl 138 may be configured to couple with the center bevel gear 124 to allow rotary motion in only one direction while inhibiting motion in an opposite direction. The pawl 138 may be referred to as a pivoting finger that is configured to engage one or more teeth of the center bevel gear 124. The pawl 138 may be coupled to the body 102 at a pivot point 140, and as such, the pawl 138 may be configured to pivot about the pivot point 140. Further, the pawl 124 may be biased with a spring (not shown) that is coupled to the body 102.

In some implementations, the center bevel gear 124 may be formed as a round gear with multiple teeth, and the pawl 138 may be implemented as a pivoting, biased finger that is configured to engage the teeth of the center bevel gear 124. Each tooth may include a gradual sloping edge on one side and a steep stepped on the other side. Alternatively, each tooth may be symmetrically formed with a profile on each edge that is substantially symmetric. When the center bevel gear 124 is rotating, and the teeth are moving in an unrestricted rotary direction, the pawl 138 may easily slide along the gradual sloping edge of each tooth. With a spring-loaded biasing, the pawl 138 may be forced over a tip of each tooth to the steep step of the other edge each tooth. When the center bevel gear 124 is rotating oppositely, and the teeth are moving in a restricted rotary direction, the pawl 138 catches against the steep stepped edge of each tooth, to thereby lock the pawl 138 against each tooth and inhibit any further motion in the restricted direction.

The gearing mechanism 110 may include a clock spring 142 coupled to the body 102. The clock spring 142 may be configured to bias the center bevel gear 124 during unrestricted rotation in the first rotary direction upon activation of the gearing mechanism 110 by compression of the rocker arm 114. In one implementation, the center bevel gear 124 may resemble a spool having an inner gear 308 and an outer gear 310 with a center ring 312 disposed therebetween, e.g., as shown in FIG. 3.

Figure 4A:
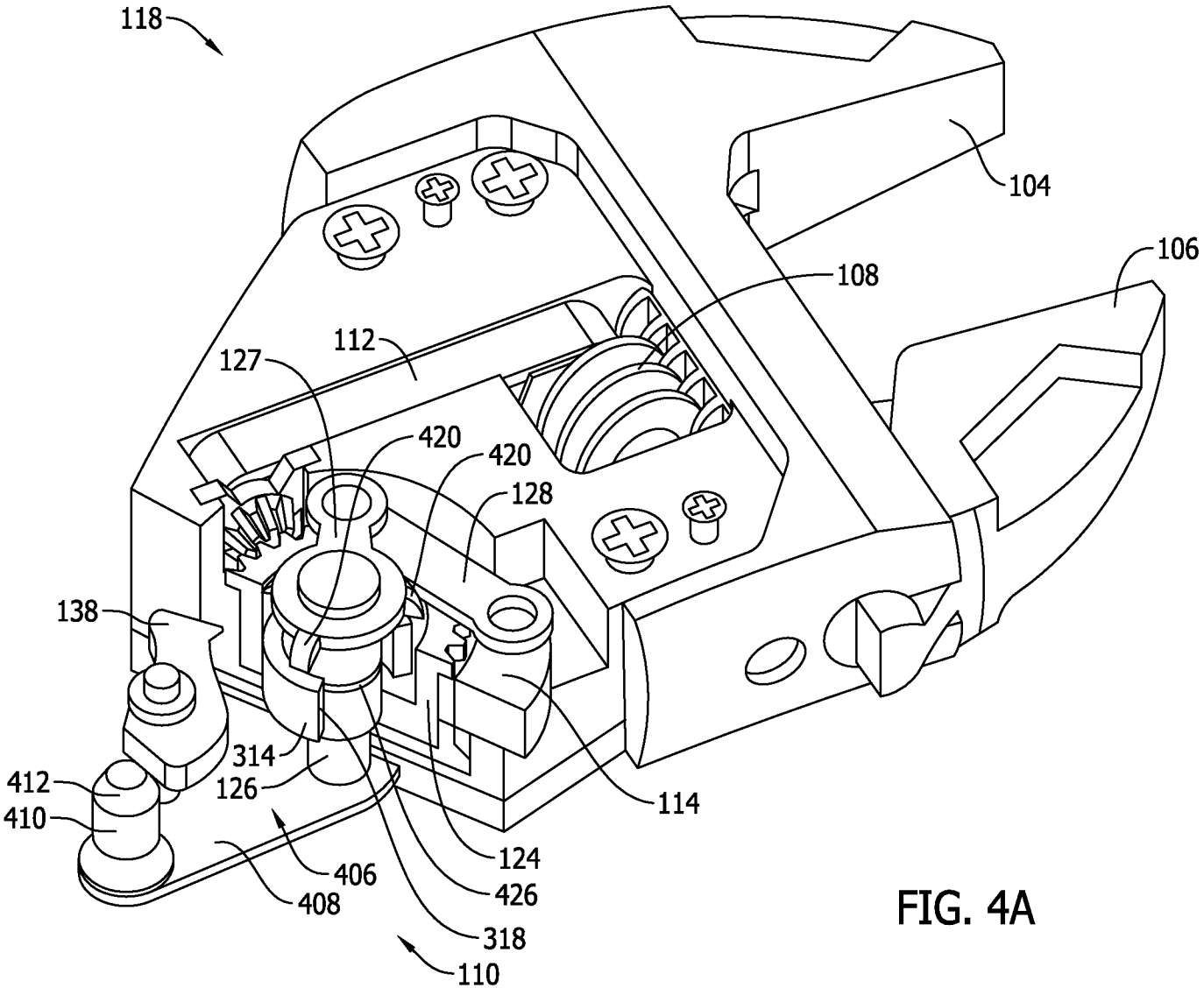
FIG. 4A and FIG. 4B illustrate schematic views of a head portion of a tool in accordance with embodiments of the present disclosure.
Figure 4B:
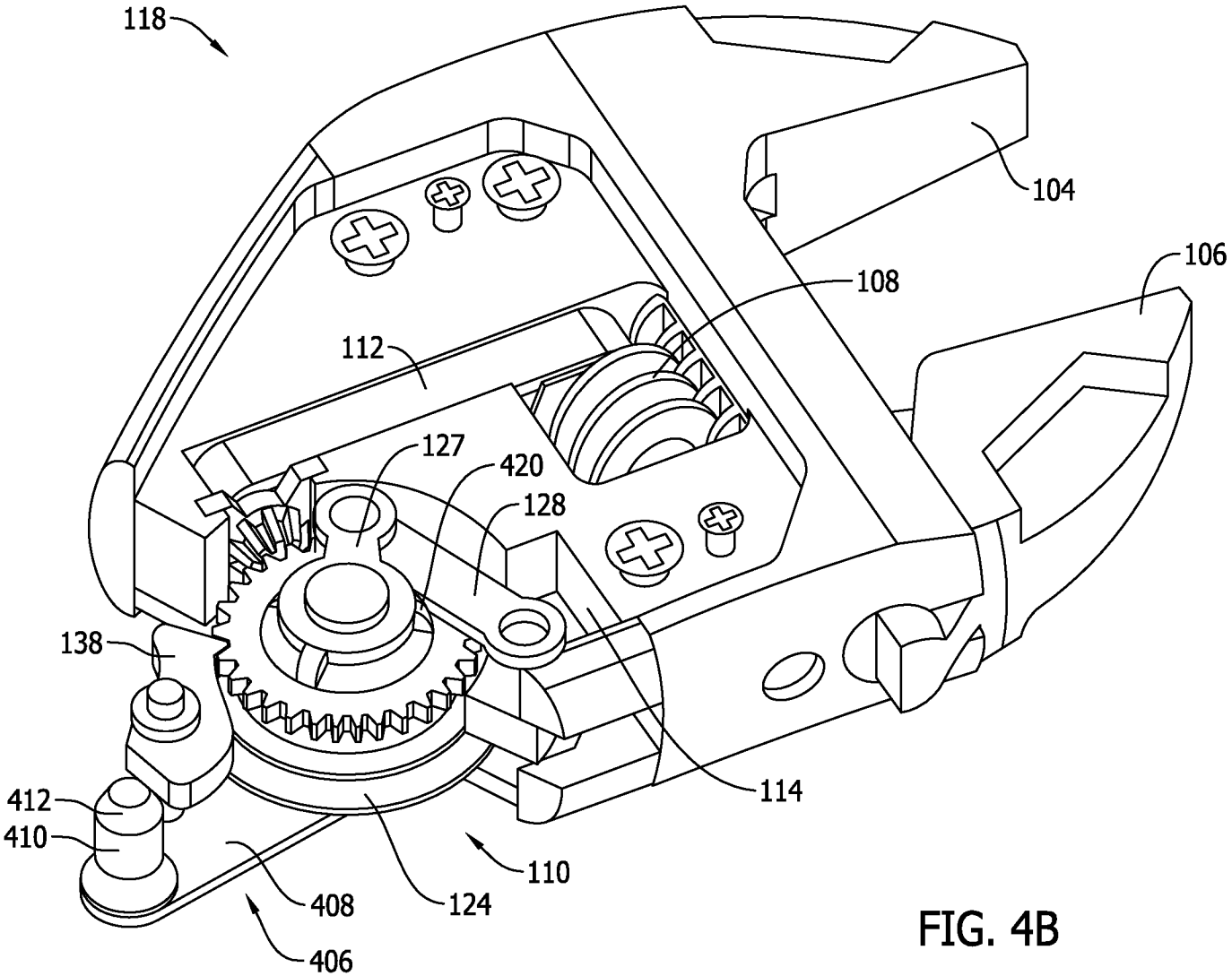
Figure 5A:
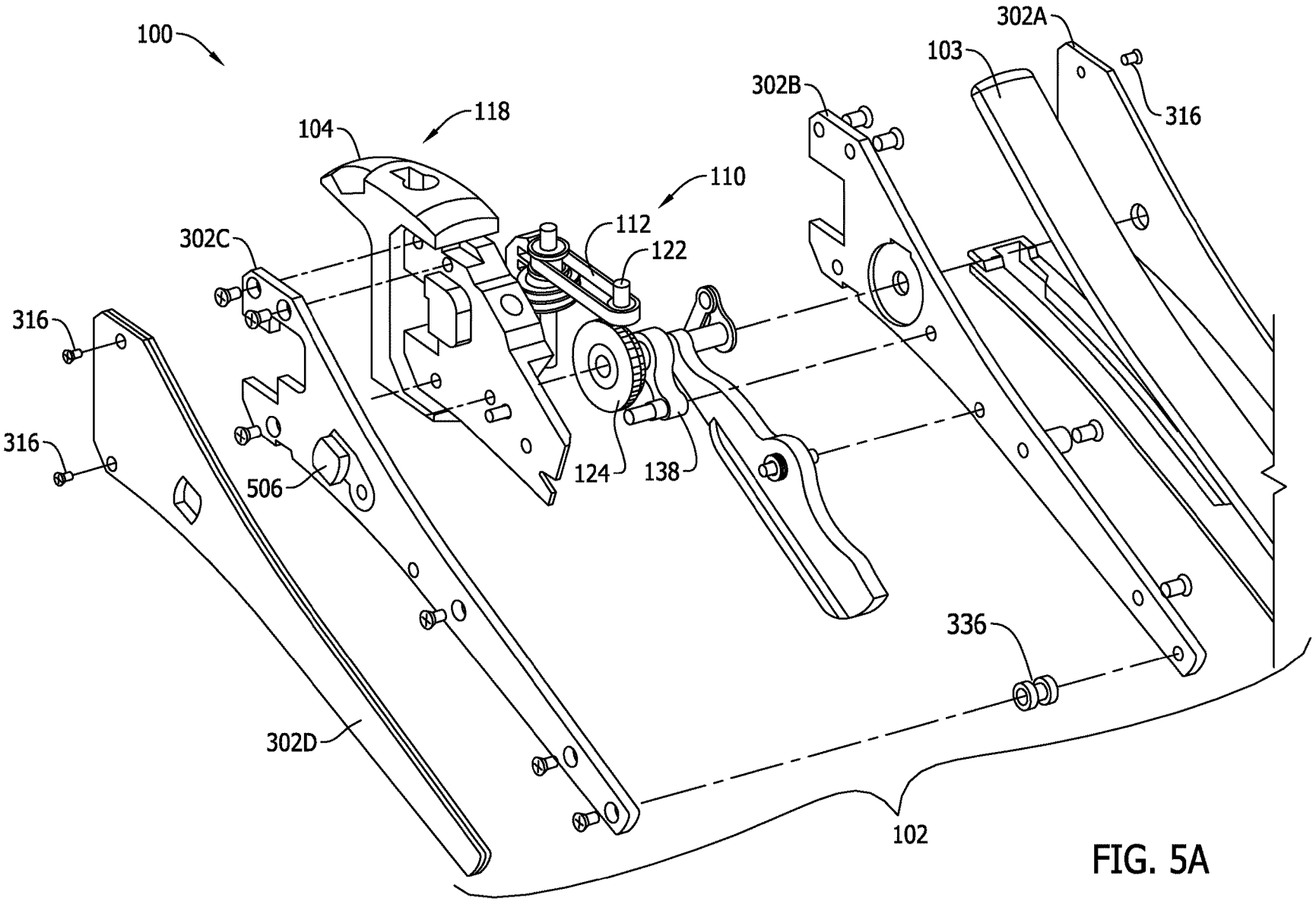
FIG. 5A and FIG. 5B illustrate exploded views of a tool in accordance with embodiments of the present disclosure.
Figure 5B:
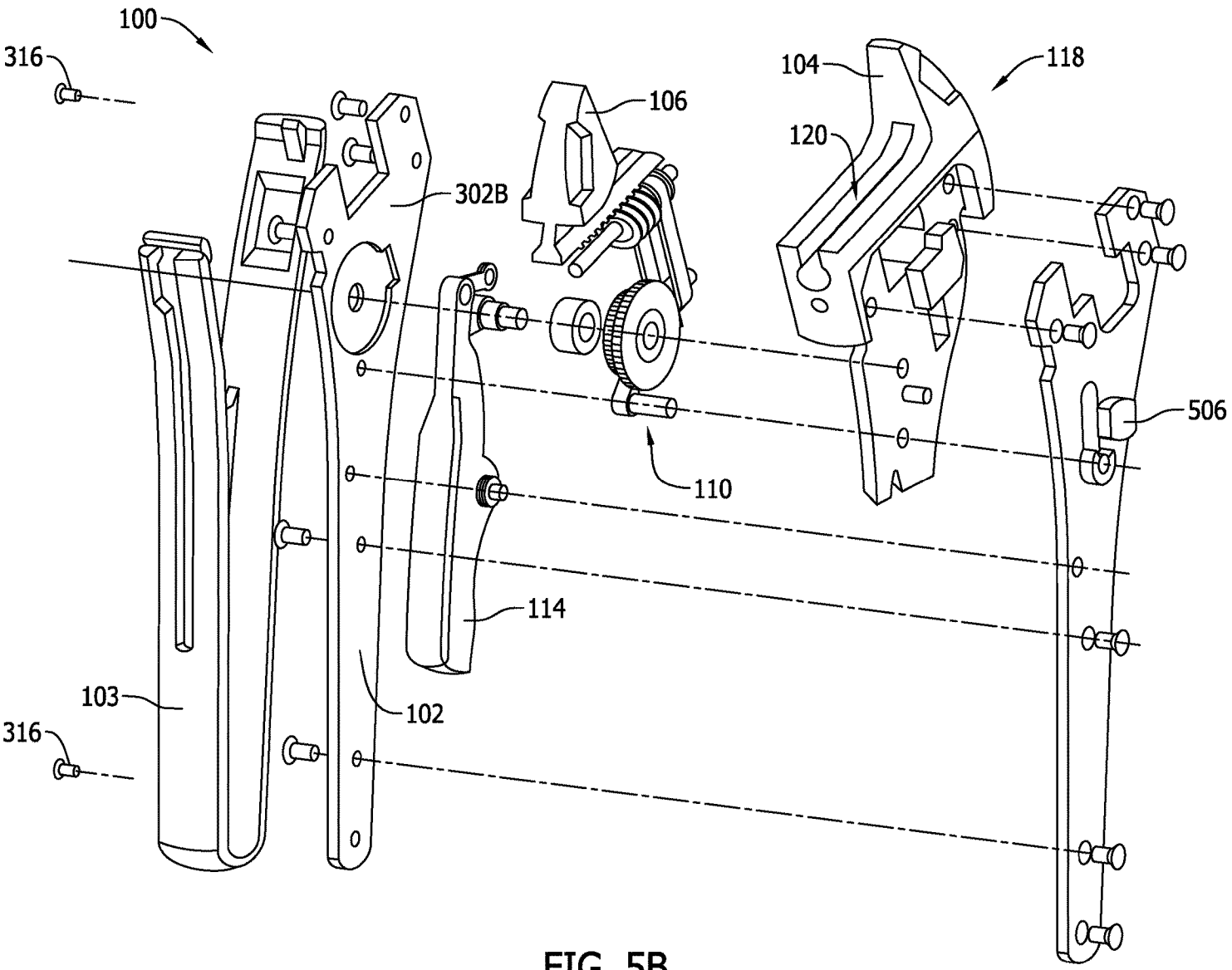

During unrestricted rotation of the center bevel gear 124, the clock spring 142 may be configured to wind around the center ring 312 and bias the center bevel gear 124. In this instance, the gearing mechanism 110 may include a release assembly 406 (shown in FIGS. 4A-4B) having a push button 506 (as shown in FIGS. 5A-5B) mounted to the body 102. In one implementation, the push button 506 may be configured to engage the pawl 138 so that upon compression of the push button 506, the pawl 138 releases from contact with the center bevel gear 124 and allows the center bevel gear 124 to freely rotate in the opposite direction, i.e., restricted direction. In this instance, the adjustable jaw 106 is configured to move in a second direction opposite the first direction (i.e., the restricted direction) and return to a default open position upon release of the pawl 138 from contact with the center bevel gear 124.

In another implementation, the push button 506 may be further configured to engage the center shaft 124 that is coupled to the center bevel gear 124 via connecting plate 408, so that upon compression of the push button 506, the center shaft 126 releases from contact with the center bevel gear 124 and allows the center bevel gear 124 to rotate in the opposite direction (i.e., the restricted direction). In this instance, the adjustable jaw 106 is configured to move in the second direction opposite the first direction and return to the default open position upon release of the center shaft 126 from contact with the center bevel gear 124. These and other aspects are described further herein.

Figure 2B:
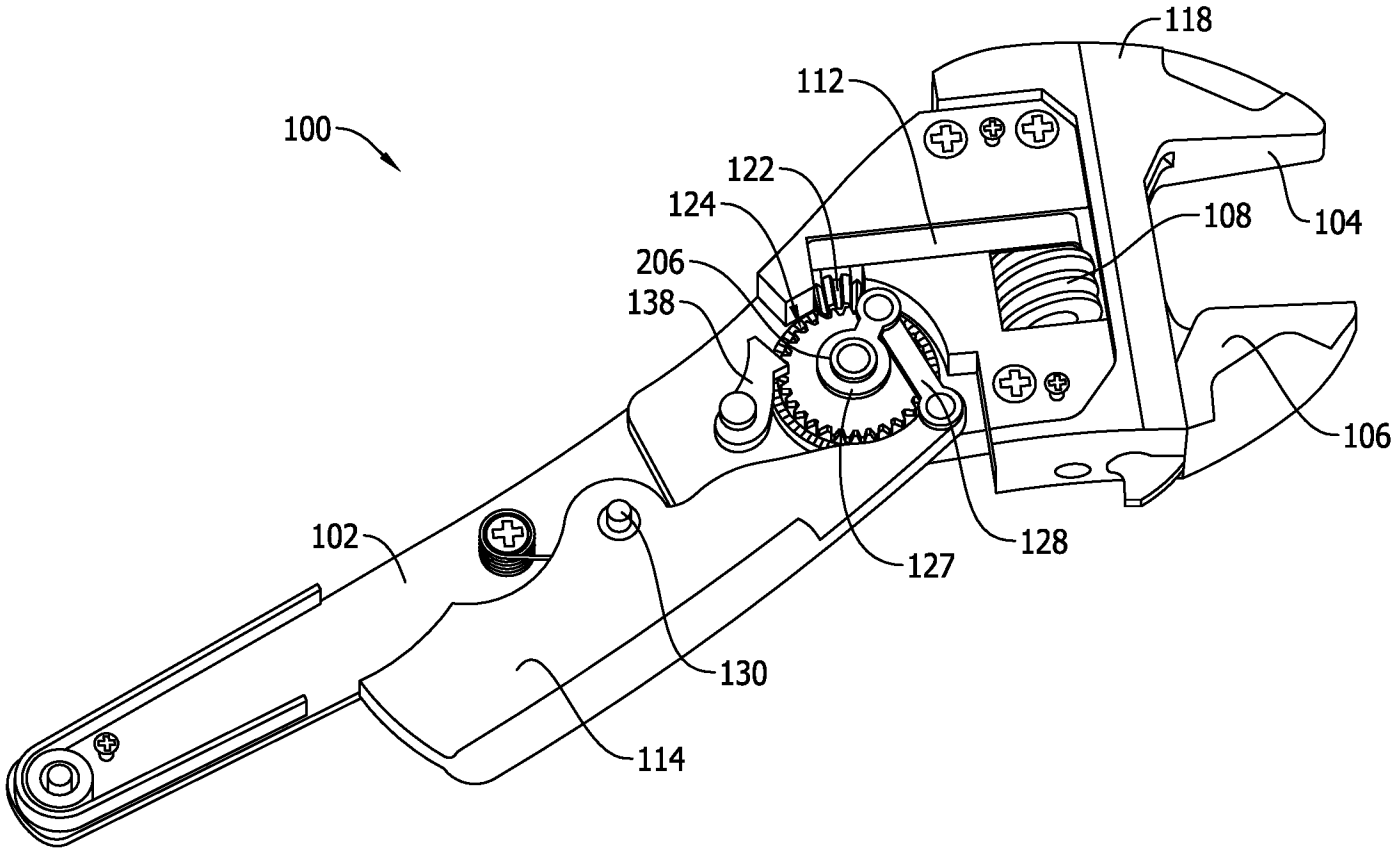

FIG. 2B illustrates another embodiment of the tool 100 in accordance with embodiments of the present disclosure. As shown in FIG. 2B, the tool 110 may include a button biasing spring 206 that may be configured to bias the push button 506 (as shown in FIGS. SA-SB) in an outward direction away from the body 102. In one implementation, biasing the push button 506 outwardly from the body 102 with the button biasing spring 206 may allow for active compression of the push button 506.

FIG. 3 illustrates another embodiment of the tool 100 in accordance with embodiments of the present disclosure. As shown in FIG. 3, the tool 110 may be formed as a laminated tool where the body 102 is formed with multiple layers 302A, 302B, 302C, 302D and components thereof, including the head assembly 118 with the fixed jaw 104 and the gearing mechanism 110 with the adjustable jaw 106. The multiple layers 302A, 302B, 302C, 302D may be coupled with fasteners or fastening members 116, 316, such as screws, such as, e.g., sheet metal screws. Further, a spacer 336 may be provided between layers 302B and 302C.

In some embodiments, the various components of the body including the head assembly 118 and layers 302A, 302B, 302C, 302D may comprise a metal-based material, such as, e.g., aluminum, steel, stainless steel, and/or any other type of metal material, including high-strength metals and various alloys of multiple different high-strength metals. In other embodiments, the body 102 and components thereof may comprise a high-strength, rigid polymer-based material. Further, portions of the body 102 and components thereof may comprise a coating of flexible and shock-absorbing type of polymer-based material, such as, e.g., an isoprene type polymer-based material, including polymer based rubber or any other type of flexible and shock-absorbing polymer-rubber based material.

In some embodiments, the coating may comprise thermos plastic rubber (TPR) or any other type of similar or comparable material, including, e.g., various polymer blends. For instance, various polymers blends may include some combination of one or more of polypropylene (PP), polyethylene (PE), block copolymer polypropylene (BCPP), rubber, and reinforcing filler(s). In some other embodiments, the materials used for forming, fabricating, and/or manufacturing the body 102 and components thereof may provide for strength, rigidity, and shock-absorbing characteristics to thereby improve reliability and longevity of the tool 100.

Further, in reference to FIG. 3, the gearing mechanism 110 may include a clutch 314 that may be configured as a one-way clutch to assist with allowing rotary motion of the center bevel gear 124 in the only one direction while inhibiting motion in the opposite direction. As shown in FIG. 3, the clutch 314 may include one or more grooves 318 that are configured to couple and/or engage with one or more corresponding crank pawls 420 of the crank plate 127 (as shown in FIGS. 4A-4B). This configuration allows the clutch 314 to couple with the center bevel gear 124, and with a one-way clutch effect, the clutch 314 only allows rotary motion in one direction while inhibiting motion in the opposite direction. Further, in some implementations, the push button 506 (as shown in FIG. 5) may be configured to disengage the clutch 314 via compression or movement of the center shaft 126. In this instance, the center shaft 126 may have a tapered contour so that, when compressed or moved, the center shaft 126 is moved along the tapered contour to release the clutch 314. This allows the biasing effect of the clock spring 142 to retract to thereby allow the adjustable jaw 106 to automatically return to the default open position.

As shown in FIG. 3, the head assembly 118 may include a spool recess or tray 330 that is configured to receive the center bevel gear 124 therein. In some implementations, the spool recess 330 may include a button aperture 332 formed therein that is configured to allow the center shaft 126 to pass through layer 302C and contact the button biasing spring 206 (as shown in FIG. 2B), which biases the push button 506 (as shown in FIGS. 5A-5B).

FIGS. 4A-4B illustrate various views of the head assembly 118 of the tool 100 in accordance with embodiments of the present disclosure. In particular, FIG. 4A shows a cut-away view of the release assembly 406 including the rocker arm 114, the center bevel shaft 124, and the clutch 314. FIG. 4B shows another view of the release assembly 406 including the rocker arm 114, the center bevel shaft 124, and the clutch 314.

As shown in FIGS. 4A-4B, the gearing mechanism 110 may include the connecting plate 408, which is coupled to the center shaft 126 (having a tapered section 426) and a pawl release pin 410 (having a tapered section 412). In one implementation, upon compression of the push button 506 (as shown in FIG. 5), the compressive force applied to the push button 506 may be transferred to the pawl release pin 410 via the connecting plate 408 and the center shaft 126. This compressive force of the push button 506 may allow the tapered portion 412 of the pawl release pin to slide along the pawl 138 to thereby release tension on pawl 138 from contact with the teeth of the center bevel gear 124. Further, in some implementations, upon compression of the push button 506, this configuration allows the center shaft 126 to simultaneously release from contact with the center bevel gear 124 and allow the center bevel gear 124 to rotate in the opposite direction (i.e., restricted direction). In this instance, the adjustable jaw 106 is configured to move in the second direction opposite the first direction and return to the default open position upon release of the center shaft 126 from contact with the center bevel gear 124.

Further, as shown in FIGS. 4A-4B, the gearing mechanism 110 may include the crank plate or link 127, which may be coupled to the center shaft 126 and the connecting rod 128. As described herein, the crank plate 127 may include the one or more crank pawls 420 that may be configured to couple and/or engage with the one or more corresponding grooves 318 formed on the exterior periphery of the clutch 314. This configuration may allow the clutch 314 to couple with the center bevel gear 124, and with a one-way clutch effect, the clutch 314 may only allow rotary motion in one direction while inhibiting motion in the opposite direction.

Further, in some implementations, the push button 506 (as shown in FIGS. 5A-5B) may be configured to disengage the clutch 314 via compression or movement of the center shaft 126. In this instance, the center shaft 126 may have the tapered contour portion 426 so that, when compressed or moved, the center shaft 126 is moved along the tapered contour portion 426 to release the grooves 318 of the clutch 314 from the crank pawls 420 of the crank plate 127. In some implementations, this configuration may allow the biasing effect of the clock spring 142 to retract and unwind from the center ring 312 of the center bevel gear 124 to thereby allow the adjustable jaw 106 to automatically return or retract to the default open position.

FIGS. 5A-5B illustrate various views of the tool 100 in accordance with embodiments of the present disclosure. In particular, as shown in FIGS. 5A-5B, the tool 100 may be formed as a laminated tool having the body 102 with the multiple layers 302A, 302B, 302C, 302D and components thereof, including the head assembly 118 with the fixed jaw 104 and the gearing mechanism 110.

As previously described herein, the gearing mechanism 110 may include the release assembly 406 having the push button 506 mounted to the body 102. The push button 506 may be configured to engage the pawl 138 so that, upon compression of the push button 506, the pawl 138 is configured to release from contact with the center bevel gear 124 thus allowing the center bevel gear 124 to rotate in the opposite direction (i.e., restricted direction). Further, the push button 506 may be configured to engage the center shaft 126 that is coupled to the center bevel gear 124, so that upon compression of the push button 506, the center shaft 126 releases from contact with the center bevel gear 124 thus further allowing the center bevel gear 124 to rotate in the opposite direction (i.e., the restricted direction). As a result, the adjustable jaw 106 may be configured to move in the second direction (i.e., restricted direction) opposite the first direction (i.e., unrestricted direction) and return to the default open position upon release of the center shaft 126 from contact with the center bevel gear 124.

Figure 6:
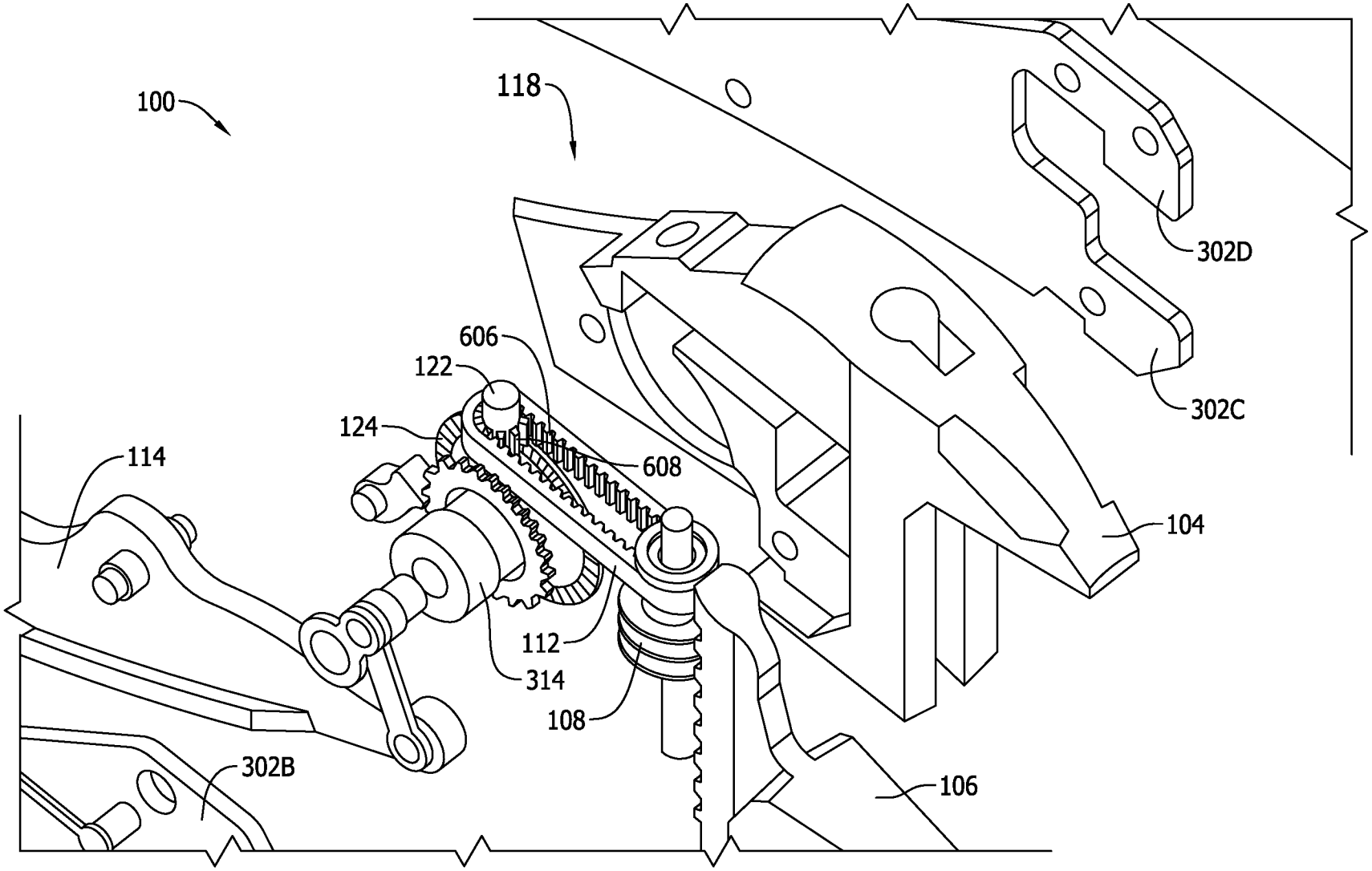
FIG. 6 illustrates an exploded view of a head portion of a tool in accordance with embodiments of the present disclosure.

FIG. 6 illustrates another embodiment of the tool 100 in accordance with embodiments of the present disclosure. As shown in FIG. 6, the tool 110 may include the belt or timing belt 112. In one implementation, the belt 112 may include teeth 606 that are configured to couple and engage to corresponding teeth (not shown) of the worm drive 108 and further couple and engage with corresponding teeth 608 of the bevel pinion 122.

As previously described herein, the gearing mechanism 110 may be coupled to the body 102 so as to engage the worm gear 108 via the belt 112, and the gearing mechanism 110 may be activated, e.g., by compression of the rocker arm 114. Further, the gearing mechanism 110 may be configured to rotate the worm gear 108 in the first direction via the belt 112 upon activation of the gearing mechanism 110 by compression of the rocker arm 114. The configuration of the engagement of the teeth 606 of the belt 112 to both the teeth (not shown) of the worm drive 108 and the teeth 608 of the bevel pinion 112 allows the compressive driving force to be transferred between the rocker arm 114 and the center bevel gear 124 to thereby move the adjustable jaw 106 toward the fixed jaw 104 upon activation of the gearing mechanism 110 by compression of the rocker arm 114.

In various implementations, the belt 112 may be formed of a flexible, high strength polymer, such as, e.g., a polymer-based rubber or any other type of flexible, high strength polymer-rubber based material. In some embodiments, the belt 112 may comprise any suitable material that is flexible and stretch resistant. In some instances, the belt 112 may include radial metal fibers, such as, e.g., steel reinforcing fibers, strands, wires, etc., encapsulated within flexible, high-strength polymer-rubber based material so as to provide additional strength while maintaining flexibility. In other implementations, the materials used for forming, fabricating, and/or manufacturing the belt 112 may provide for flexibility and high-strength characteristics to thereby improve reliability and longevity of the tool 100.

Figure 7:
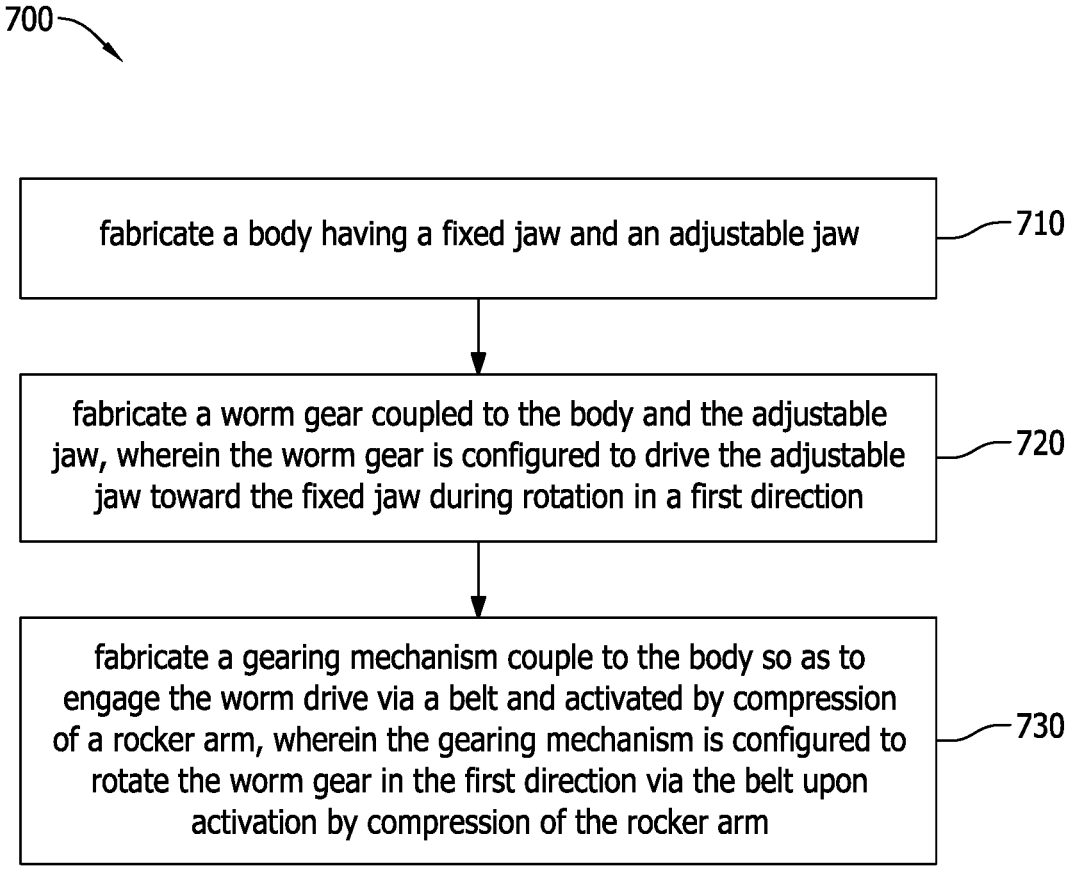
FIG. 7, FIG. 8, and FIG. 9 illustrate process flow diagrams of methods for manufacturing a tool in accordance with embodiments of the disclosure.
Figure 8:
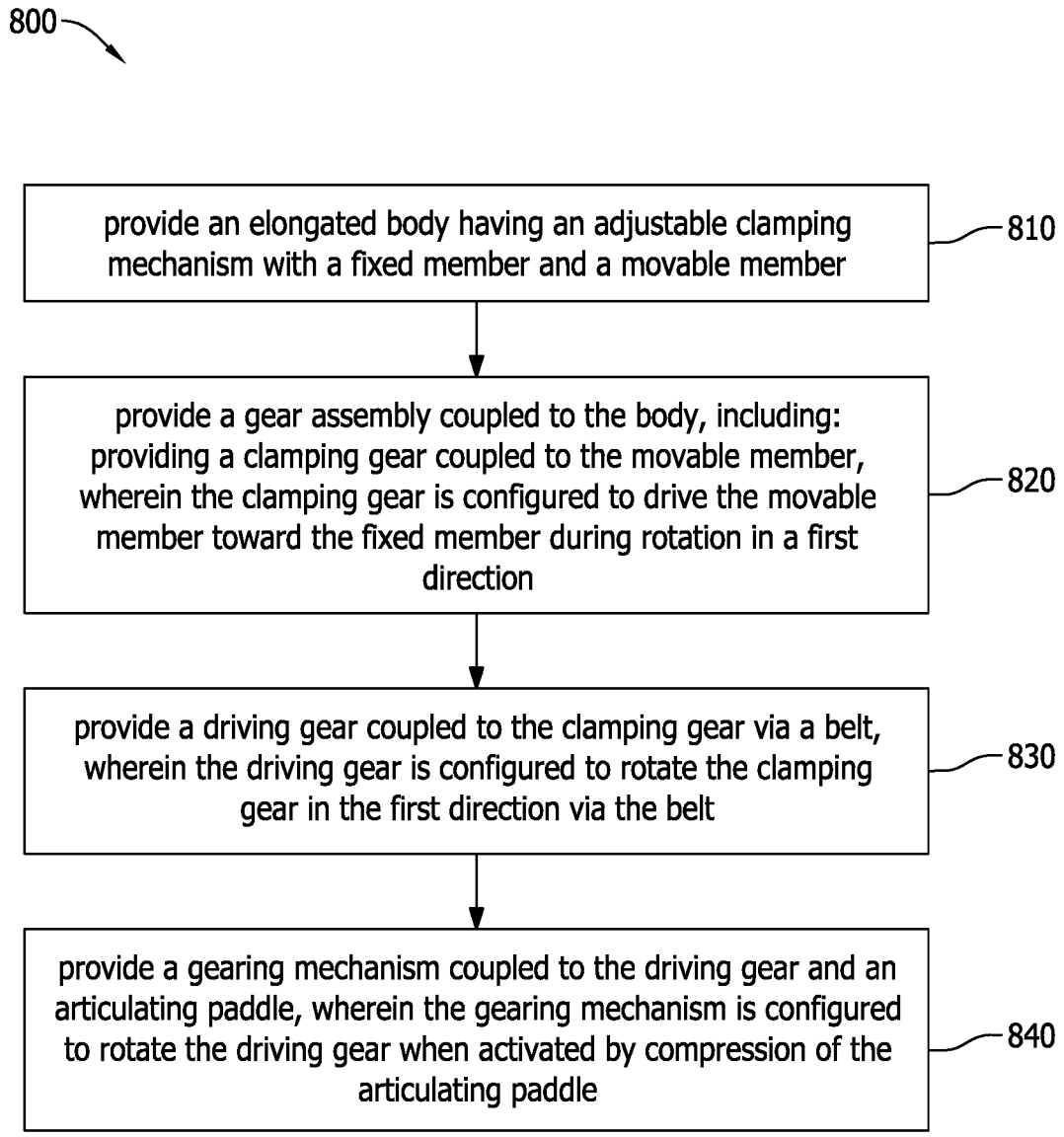
Figure 9:
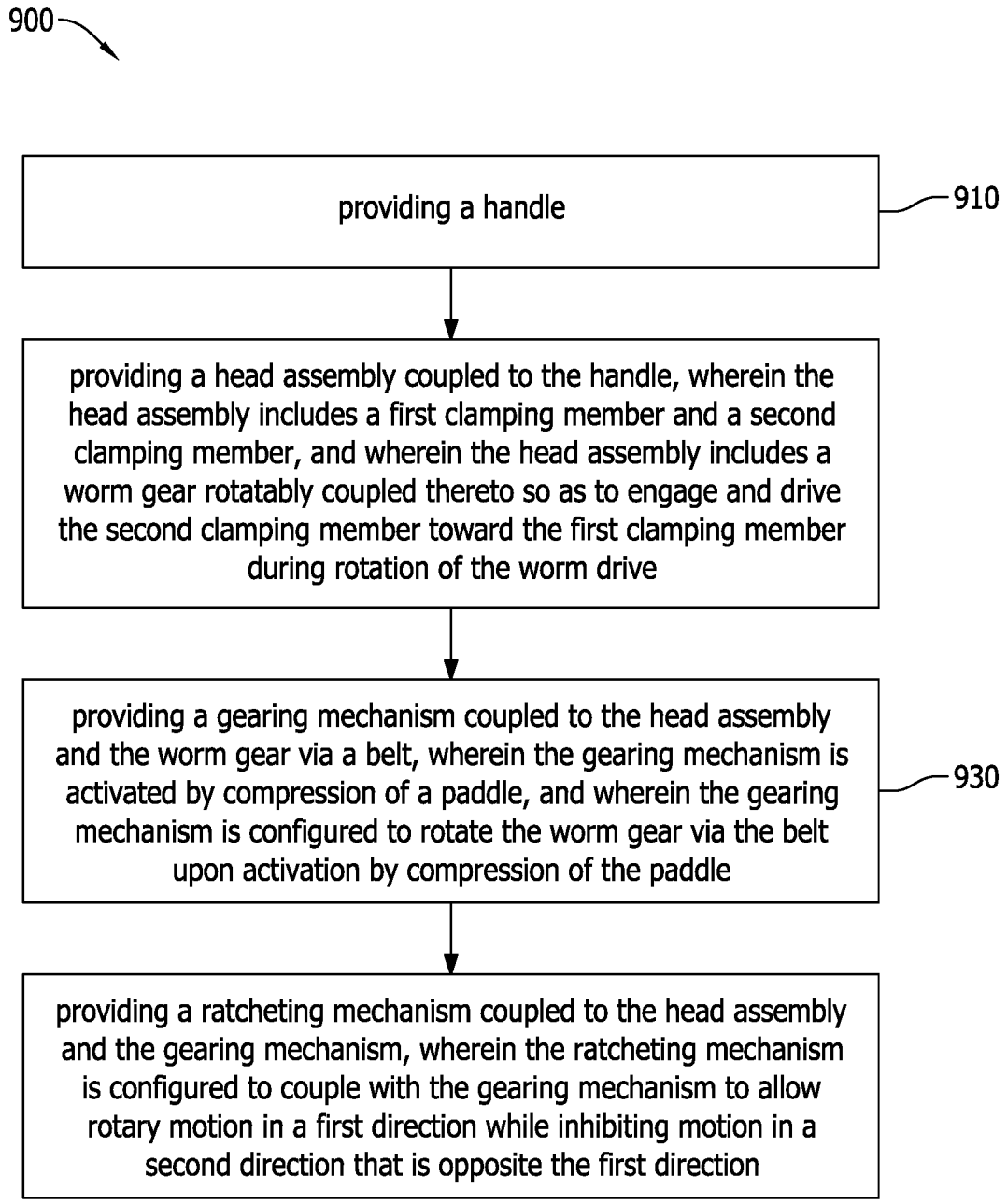

FIGS. 7-9 illustrate process flow diagrams of methods for manufacturing the tool 100 in accordance with embodiments of the disclosure.

In particular, FIG. 7 illustrates a process flow diagram for a method 700 of manufacturing the tool 100 in accordance with implementations described herein. It should be understood that while method 700 indicates a particular order of execution of operations, in some examples, certain portions of the operations might be executed in a different order, and on different systems. In some other examples, one or more additional operations and/or steps may be added to method 700. Similarly, some operations and/or steps may be omitted. Further, in reference to method 700 of FIG. 7, steps 710-730 are described with reference to FIGS. 1-6.

At block 710, method 700 may fabricate a body having a fixed jaw and an adjustable jaw. In some embodiments, the body may be formed or integrated as part of a device, apparatus, or tool, and the body may be contoured as an elongated handle of the device, apparatus, or tool.

At block 720, method 700 may fabricate a worm gear coupled to the body and the adjustable jaw. In various embodiments, the worm gear may be configured to drive the adjustable jaw toward the fixed jaw during rotation in a first direction.

At block 730, method 700 may fabricate a gearing mechanism coupled to the body so as to engage the worm drive via a belt and activated by compression of a rocker arm. In various embodiments, the gearing mechanism may be configured to rotate the worm gear in the first direction via the belt upon activation by compression of the rocker arm. In this instance, the worm gear may be configured to rotate within the body upon activation of the gearing mechanism by compression of the rocker arm.

FIG. 8 illustrates a process flow diagram for a method 800 of manufacturing the tool 100 in accordance with implementations described herein. It should be understood that while method 800 indicates a particular order of execution of operations, in some examples, certain portions of the operations might be executed in a different order, and on different systems. In some other examples, one or more additional operations and/or steps may be added to method 800. Similarly, some operations and/or steps may be omitted.

Further, in reference to method 800 of FIG. 8, steps 810-830 are described with reference to FIGS. 1-6.

At block 810, method 800 may provide an elongated body having an adjustable clamping mechanism with a fixed member and a movable member. In some embodiments, the elongated body may be formed or integrated as part of a device, apparatus, or tool, and the elongated body may be contoured as an elongated handle of the device, apparatus, or tool.

At block 820, method 800 may provide a gear assembly coupled to the body. In some implementations, providing the gear assembly may include providing a clamping gear coupled to the movable member. The clamping gear may be configured to drive the movable member toward the fixed member during rotation in a first direction.

At block 830, method 800 may provide a driving gear coupled to the clamping gear via a belt. In some implementations, providing the gear assembly may include providing the driving gear coupled to the clamping gear via a belt. The driving gear may be configured to rotate the clamping gear in the first direction via the belt.

At block 840, method 800 may provide a gearing mechanism coupled to the driving gear and an articulating paddle. In some implementations, providing the gear assembly may include providing the gearing mechanism coupled to the driving gear and an articulating paddle. The gearing mechanism may be configured to rotate the driving gear when activated by compression of the articulating paddle.

FIG. 9 illustrates a process flow diagram for a method 900 of manufacturing the tool 100 in accordance with implementations described herein. It should be understood that while method 900 indicates a particular order of execution of operations, in some examples, certain portions of the operations might be executed in a different order, and on different systems. In some other examples, one or more additional operations and/or steps may be added to method 900. Similarly, some operations and/or steps may be omitted.

Further, in reference to method 900 of FIG. 9, steps 910-930 are described with reference to FIGS. 1-6.

At block 910, method 900 may provide a handle. In some embodiments, the handle may be formed or integrated as part of a device, apparatus, or tool, and the handle may be contoured as an elongated body of the device, apparatus, or tool.

At block 920, method 900 may provide a head assembly coupled to the handle. In some embodiments, the head assembly includes a first clamping member and a second clamping member. Further, the head assembly may include a worm gear rotatably coupled thereto so as to engage and drive the second clamping member toward the first clamping member during rotation of the worm drive.

At block 930, method 900 may provide a gearing mechanism coupled to the head assembly and the worm gear via a belt. In some embodiments, the gearing mechanism is activated by compression of a paddle, and the gearing mechanism may be configured to rotate the worm gear via the belt upon activation by compression of the paddle.

At block 940, method 900 may provide a ratcheting mechanism coupled to the head assembly and the gearing mechanism. In some embodiments, the ratcheting mechanism may be configured to couple with the gearing mechanism to thus allow rotary motion in a first direction while inhibiting motion in a second direction that is opposite the first direction.

Figure 10:
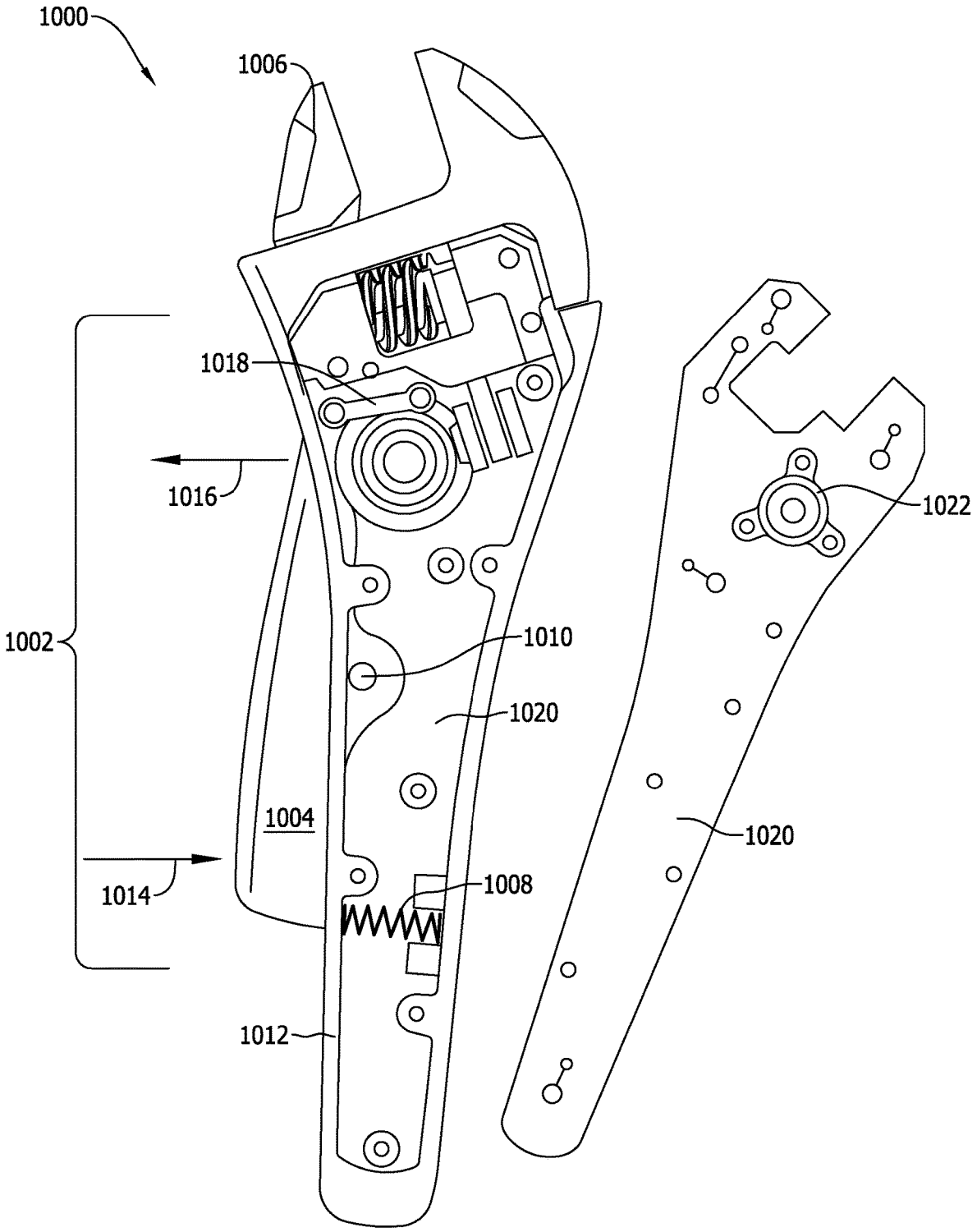
FIG. 10 illustrates a cut-away view of a tool in accordance with embodiments of the disclosure.

FIG. 10 is a side view diagram illustrating one embodiment of a tool 1000 with a drive mechanism for a hand tool. As used herein, the phrase "drive mechanism" refers to a combination of components that include a drive shaft. In the depicted embodiment, the drive mechanism 1002 includes various components, some of which have been described above, for transferring a user-supplied force from a rocker lever 1004 to a moveable jaw 1006. The drive mechanism 1002, in one embodiment, transfers a rocking, or oscillating, movement (such as applied to the rocker lever 1004) into a linear movement of the moveable jaw 1006.

The rocker lever 1004 pivots about pivot point 1010 and is biased by spring 1008. The default position of the rocker lever 1004 is, as depicted, extended away from the hand tool frame 1012. When a user pushes on one end of the rocker lever 1004, as illustrated by arrow 1014, the other end of the rocker lever extends out of the frame (arrow 1016) and pulls a linkage arm 1018. As will be discussed in greater detail below, the linkage arm 1018 is coupled to a drive shaft via a one-way bearing or clutch. The drive shaft turns a center ring that is coupled to a pinion gear. The pinion gear drives a belt, which as is described above, turns a worm gear that advances the moveable jaw 1006.

As discussed above with reference to FIGS. 1-9, the hand tool 1000 may be a laminated hand tool. Stated differently, the hand tool 1000 may be formed having multiple sheets of material that form the frame or exterior of the hand tool 1000. In the depicted embodiment, different components of the drive mechanism 1002 may be mounted on one or both base plates 1020. For example, a one-way bearing mount 1022 may be coupled with one of the base plates 1020.

Figure 11:
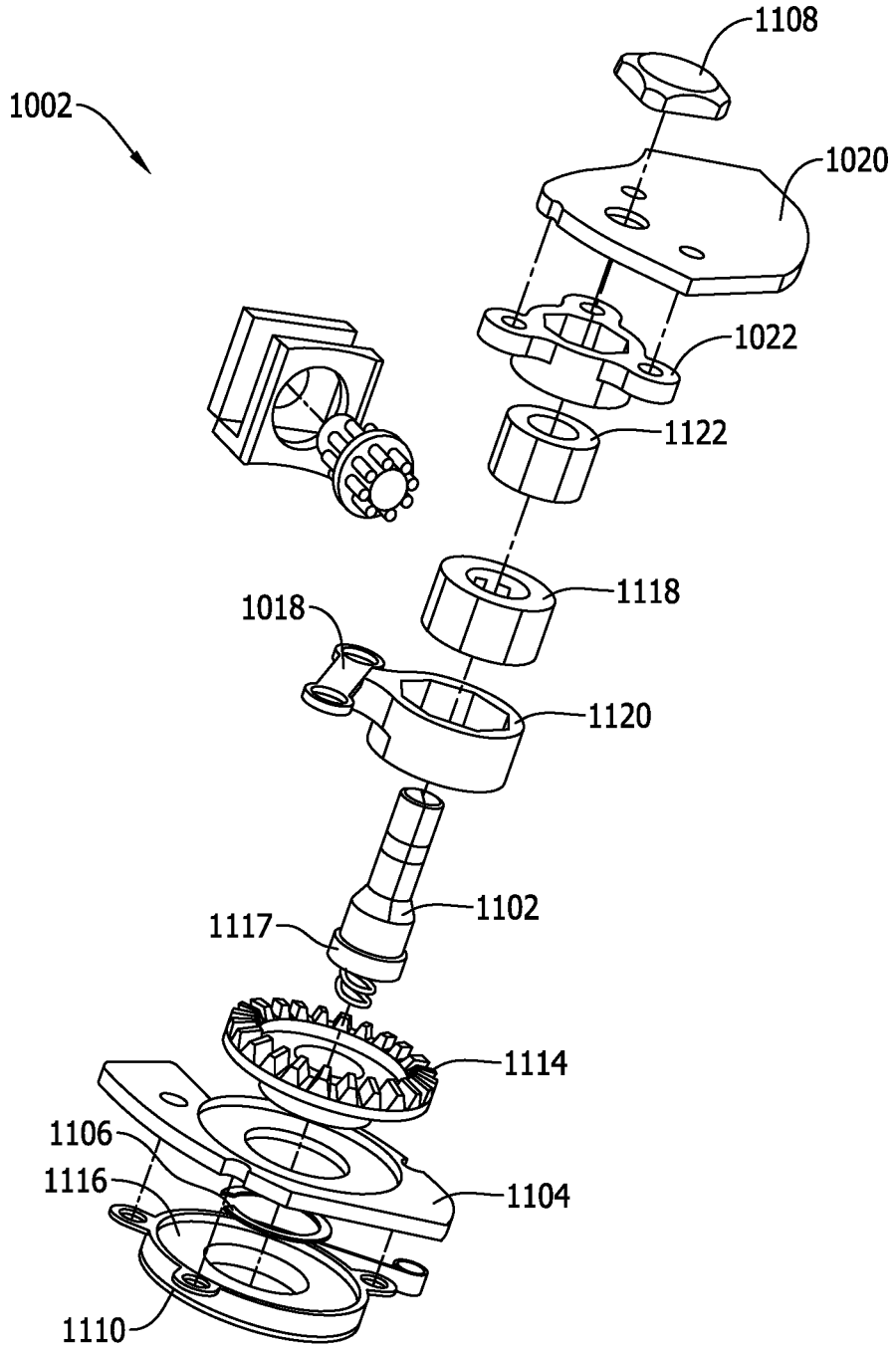
FIG. 11 illustrates an exploded view showing a gearing mechanism in accordance with embodiments of the disclosure.
Figure 12:
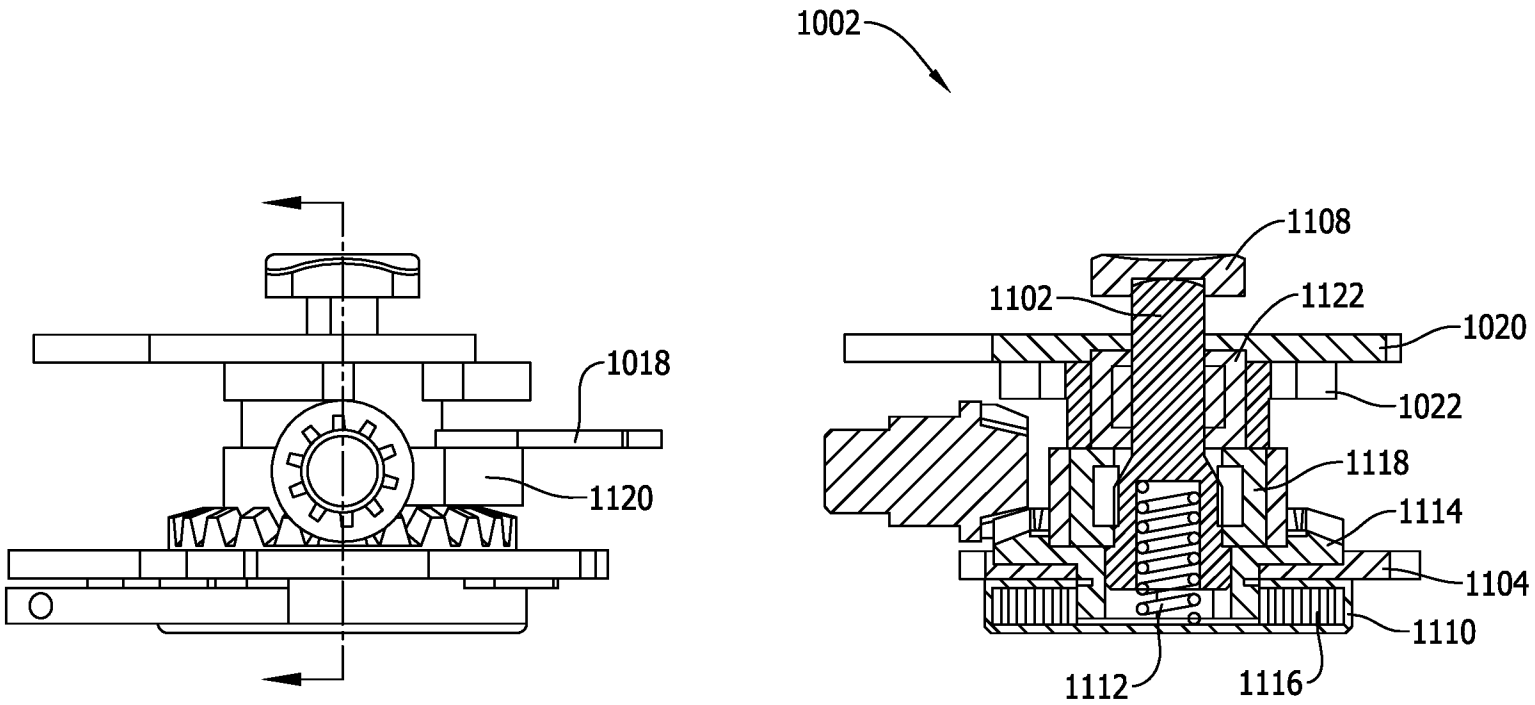
FIG. 12 illustrates a schematic view of a gearing mechanism in accordance with embodiments of the disclosure.

FIG. 11 is an exploded view diagram illustrating one embodiment of the drive mechanism 1002, and FIG. 12 is a schematic view illustrating an embodiment of the drive mechanism 1001, in accordance with embodiments of the present disclosure. In the depicted embodiment, the components of the drive mechanism 1002 are generally positioned concentrically with a longitudinal axis of the drive or center shaft 1102. In other words, the other components of the drive mechanism 1002 are coupled to or engage the center shaft 1102 in a manner that the center shaft 1102 extends through the center of the components.

In one embodiment, the center shaft 1102 couples with a base plate 1104. A lock ring 1106 couples with the base of the center shaft 1102 and maintains the position of the center shaft 1102 with respect to the base plate 1104. In one embodiment, the lock ring 1106 prevents the center shaft 1102 from traveling "upward" (i.e., "upward" used as reference to FIG. 11) towards a button 1108. However, the lock ring 1106 is configured to allow the center shaft 1102 to move in an opposite direction towards a spring holder 1110. As will be described in greater detail below, a user may push on the button 1108 which in turn causes the center shaft 1102 to move towards the spring holder 1110 and thereby disengage the center shaft 1102 from the one-way bearings. Spring 1112 biases the center shaft 1102 and urges the center shaft 1102 away from the spring holder 1110. In other words, in one embodiment, the center shaft 1102 is in a default position of engagement with the one-way bearings, and transitions to a position of disengagement when the button 1108 is pressed.

The base plate 1104 is disposed between the lock ring 1106 and a center gear 1114. The center shaft 1102 may be formed with flat areas 1117 for engaging a corresponding area of the center gear 1114. As such, a rotation of the center shaft 1102 is transferred to the center gear 1114, and the coil spring 1116. In an alternative embodiment, when the center shaft 1102 is pressed downward, and out of engagement with the one-way bearings and center gear 1114, the center gear 1114 may rotate freely with reference to the center shaft 1102. In this situation, and because the center gear 1114 may be coupled with the coil spring 1116, the coil spring 1116 exerts a force on the center gear 1114 as the coil spring 1116 unwinds. This causes the center gear 1114 to return to a "home" or default position. As will be described below, the center gear 1114 causes the moveable jaw to move, and accordingly, when the coil spring 1116 unwinds, the moveable jaw opens.

In the depicted embodiment, the center shaft 1102 has a graduated profile. In other words, the center shaft 1102 has a greater diameter near the base than near the tip. This helps with alignment of the center shaft 1102 as it moves in and out of engagement with the one-way bearings and the center gear 1114.

A first one-way bearing 1118 or clutch may be disposed within a crank arm 1120. The crank arm 1120 is coupled with the linkage arm 1018 that is coupled with the rocker lever 1004 depicted in FIG. 10. In operation, the crank arm 1120 pivots back and forth as the rocker lever 1004 rocks about the rocker pivot point 1010 (depicted in FIG. 10). This pivoting motion, in one embodiment, does not encompass a full 360 degree rotation, but instead encompasses movement in the range of between about 5 and 50 degrees. The one-way bearing 1118 transfers the crank arm 1120 movement from the linkage arm 1018 to the center shaft 1102.

The one-way bearing 1118 is formed having an inner and an outer surface, also known as inner race and outer race. By definition, a one-way bearing allows the inner race and the outer race to move in only a single direction, with respect to each other. In other words, both surfaces may move together in a clockwise direction, but not in separate directions. If one of the surfaces is fixed, the other surface may still rotate in a single direction. Accordingly, the rocking, or back and forth, movement of the crank arm 1120 causes the center shaft 1102 to advance in a single direction. As the crank arm 1120 moves forward (i.e., in a clockwise direction) so does the center shaft 1102. However, as the crank arm 1120 retreats (i.e., in a counter-clockwise direction) the inner race of the one-way bearing 1118 spins freely and does not drive the center shaft 1102. The second one-way bearing 1122 prevents the center shaft 1102 from retreating with the crank arm 1120. The one-way bearings 1118, 1120, in one embodiment are arranged to only allow movement of the center shaft 1102 in a single direction (i.e., either clockwise or counter-clockwise). This is achieved by fixing the outer surface of the one way bearing 1122 with reference to the base plate 1020. A clutch mount 1022 that is coupled with the base plate 1020 may fixedly couple the outer race of the one-way bearing 1122. In other words the outer race of the one way bearing 1122 is rotationally fixed, it does not rotate.

As described above, the push button is in engagement with the center shaft such that a pushing force on the push button causes the center shaft to compress the compression spring and move the center shaft towards the coil spring holder. This movement causes the graduated center shaft to disengage from both one-way bearings (i.e., 1-way roller clutch). Once the center shaft is disengaged from the one-way bearings, and potential energy stored in the coil spring causes the coil spring to relax (i.e., unravel) and also rotate the center gear. As a result, the center gear turns the pinion gear.

Figure 13:
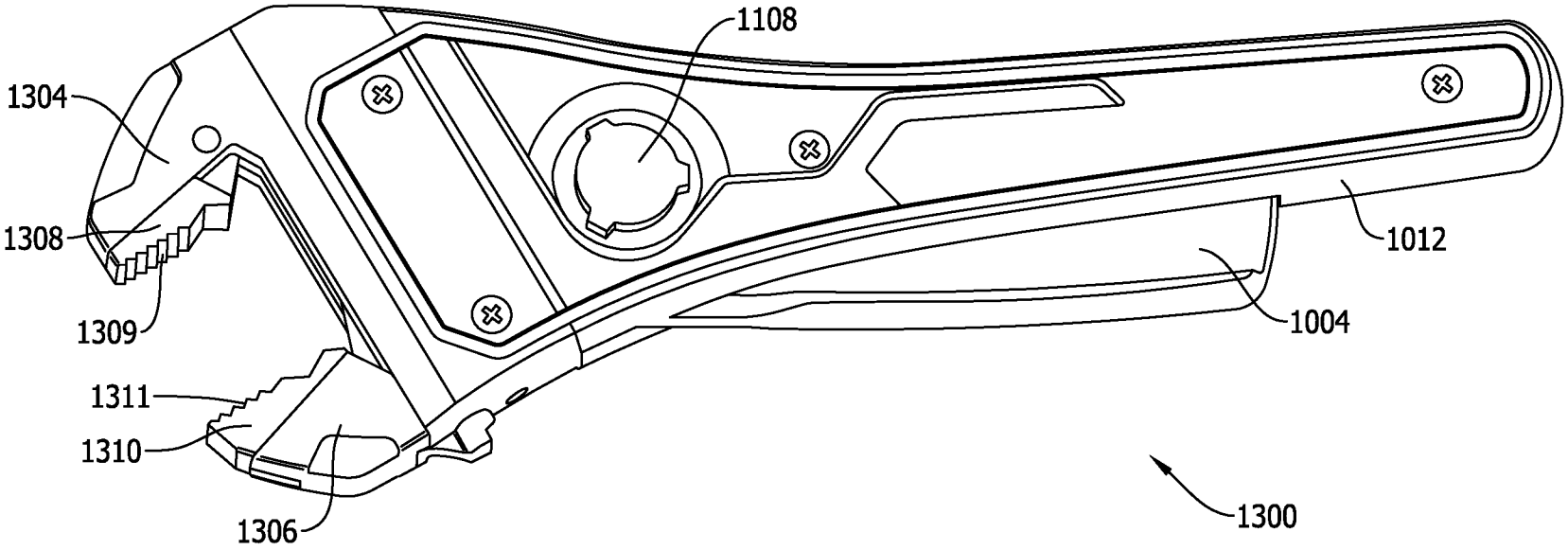
FIG. 13 illustrates one embodiment of a tool in accordance with embodiments of the disclosure.

In another embodiment, a modified tool head is provided that achieves a "ratcheting" effect during use. FIG. 13 illustrates a tool 1300 that has a tool body 1012 and rocker arm 1004 similar to those described above. The tool 1300 has gearing (not shown) similar to the tools 1002, 100 described above and a description will not be repeated hear. Thus, similar to tools 1002, 100, an adjustable jaw 1306 may be moved towards a fixed jaw 1304 by manipulation of the rocker arm 1004 via the gearing mechanism. The adjustable jaw 1306 may return to an open position by pressing a push button 1108, as described above.

The fixed jaw 1304 comprises a first jaw insert 1308. The first jaw insert 1308 may comprise teeth 1309 or other interfacing surface to interface with a work piece such as a polygonal bolt head. Similarly, the adjustable jaw 1306 comprises a second jaw insert 1310. The second jaw insert 1310 may comprise teeth 1310 or other interfacing surface to interface with a work piece such as a polygonal bolt head.

Figure 14:
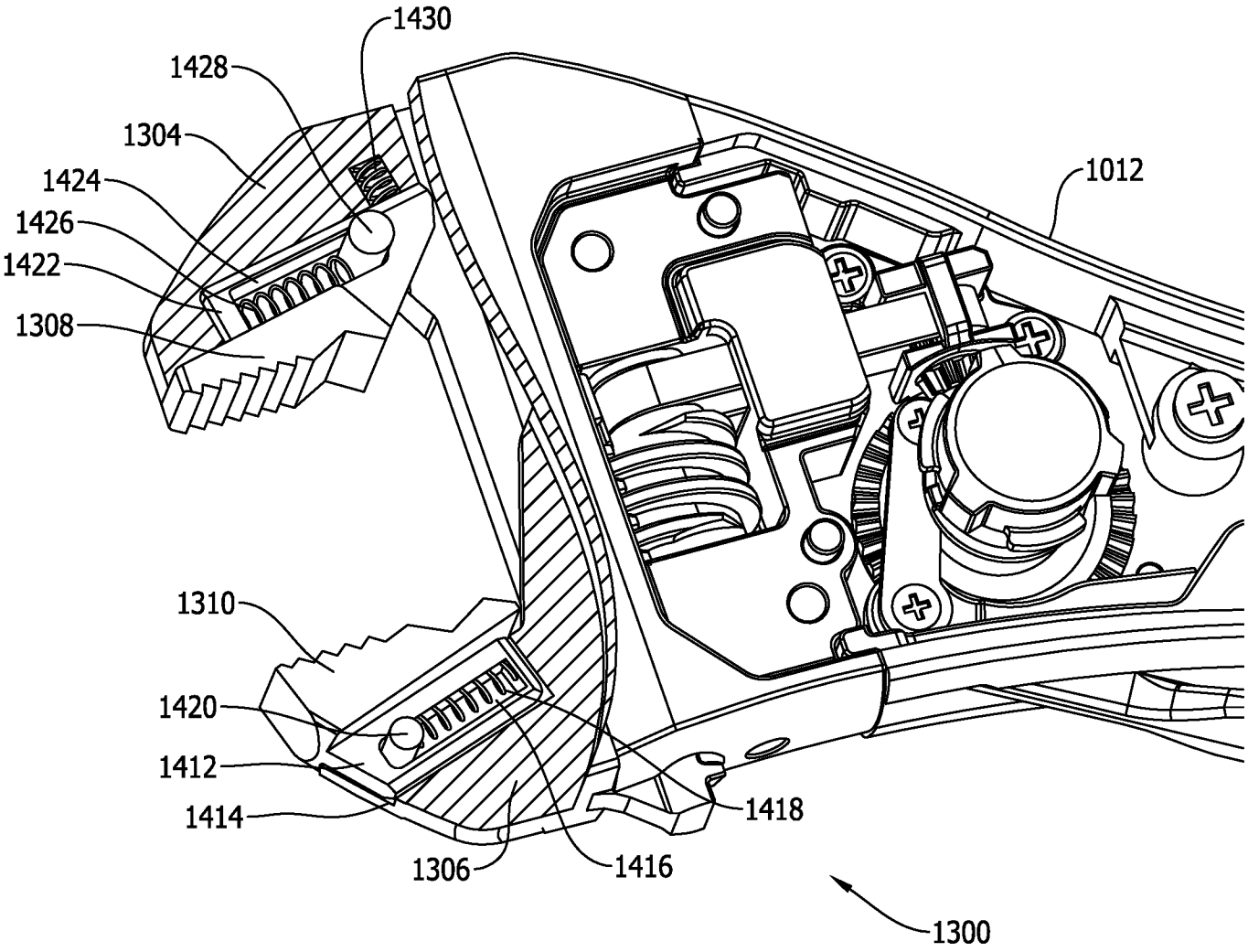
FIG. 14 illustrates a view of a head portion of a tool in accordance with embodiments of the disclosure.

FIG. 14 shows a cut-away, schematic view of the tool 1300. In FIG. 14, the second jaw insert 1310 of the adjustable jaw 1306 comprises a flange 1412 that is housed at least partially within and can slide within a slot 1414 of the adjustable jaw 1306. The flange 1412 comprises an elongated aperture 1416, recess or the like that houses a compression spring 1418. A dowel 1420, or a pin or other stop, is provided that extends through both the adjustable jaw 1306 and the elongated aperture 1416. The dowel 1420 prevents the second jaw insert 1310 from sliding towards the tool body 1012. The dowel 1420 interacts with the compression spring 1418 to bias the second jaw insert 1310 towards the tool body 1012 while allowing movement away from the tool body 1012 when a sufficient force acts on the jaw insert 1310.

Similarly, the first jaw insert 1308 of the fixed jaw 1304 comprises a flange 1422 that is housed at least partially within and can slide within a slot (not shown) of the fixed jaw 1304. The flange 1422 comprises an elongated aperture 1424, recess or the like that houses a compression spring 1426. A dowel 1428, pin or other stop is provided that extends through both the fixed jaw 1304 and the elongated aperture 1424. The dowel 1428 prevents the first jaw insert 1308 from sliding away from the tool body 1012. The dowel 1428 interacts with the compression spring 1426 to bias the first jaw insert 1308 away from the tool body 1012 while allowing movement towards the tool body 1012 when a sufficient force acts on the first jaw insert 1308. Additionally, a lateral compression spring 1430 is provided to balance the first jaw insert 1308 during use. The later spring 1430 provides stability to the jaw insert 1308 so that the jaw insert moves smoothly along the intended direction of travel of the jaw insert 1308.

The "ratcheting" mechanism of the tool 1300 is described with reference to FIG. 15. The tool 1300 may be used to tighten a fastener 1502. Here, the fastener 1502 is shown as having a hexagonal head. When the tool 1300 is torqued by a user in a first direction shown as arrow T1, the first and second jaw inserts 1308, 1310 of the fixed jaw 1304 and adjustable jaw 1306 remain in their initial positions P1 as biased by the compression springs 1418, 1426. This is because when the tool 1300 is torqued in the direction T1, the jaw insert 1308 of the fixed jaw 1304 experiences a reaction force opposite F1 away from the tool body 1012. The dowel 1428 and flange 1422 prohibit movement of the first jaw insert 1308 in this direction, and thus the jaw insert 1308 remains fixed and transfers the torque T1 to the fastener 1502. Similarly, when the tool 1300 is torqued in the direction T1, the second jaw insert 1310 of the adjustable jaw 1306 experiences a reaction force opposite F2 towards the tool body 1012. The dowel 1420 and flange 1412 within the slot 1414 prohibit movement of the second jaw insert 1310 in this direction, and thus the second jaw insert 1310 remains fixed and transfers the torque T1 to the fastener 1502.

Alternatively, when the tool 1300 is torqued by a user in a second direction shown as arrow T2, the first and second jaw inserts 1308, 1310 of the fixed jaw 1304 and adjustable jaw 1306 slide within respective slots and relative to the fixed jaw 1304 and adjustable jaw 1306 to a position P2, allowing the fixed and adjustable jaws 1304, 1306 to slip over the fastener 1502. In this manner, the tool 1300 can operate in a "ratcheting" fashion where the tool 1300 tightens a fastener in a single direction without adjusting (e.g. opening) the adjustable jaw 1306 or removing the tool 1300 from the fastener 1502.

Specifically, when the tool 1300 is torqued in direction T2, the first jaw insert 1308 of the fixed jaw 1304 experiences a reaction force of F1 towards the tool body 1012. When F1 exceeds the force of the compression spring 1426, the first jaw insert 1308 slides within the slot towards the tool body 1012 from position P1 towards position P2. As the tool is turned, the first jaw insert 1308 continues to move. The angle at which the first jaw insert 1308 moves is oblique relative to the plane of the teeth 1309 or interaction surface of the fixed jaw insert 1308 as shown by angle $\alpha$. Thus, as the first jaw insert 1308 moves towards the tool body 1012 to position P2, the space between the fixed jaw 1304 and the adjustable jaw 1306 increases.

Similarly, when the tool 1300 is torqued in the direction T2, the second jaw insert 1310 of the adjustable jaw 1306 experiences a reaction force of F2 away from the tool body 1012. When F2 exceeds the force of the compression spring 1418, the second jaw insert 1310 slides within the slot 1414 away from the tool body 1012 from position P1 towards position P2. As the tool is turned, the second jaw insert 1310 continues to move. The angle at which the second jaw insert 1310 moves is oblique relative to the plane of the teeth 1311 the adjustable jaw insert 1310 as shown by angle $\alpha$. Thus, as the second jaw insert 1310 moves away from the tool body 1012, the space between the fixed jaw 1304 and the adjustable jaw increases.

When the space between the fixed jaw 1304 and the adjustable jaw 1306 is sufficient, the jaws 1304, 1306 slip over the fastener 1502. That is, the space created by the movement of the first and second jaw inserts 1308, 1310 allows the jaws 1304, 1306 to clear the corners of the head of the fastener 1502 (e.g. corners of the hexagonal head) and advance to the next sides of the head of the fastener 1502 (e.g. sides of the hexagonal head). When the jaws 1304, 1306 clear the corners, the compression springs 1418, 1426 push the first and second jaw inserts 1308, 1310 back to their original positions (e.g. back to position P1 from position P2). Thus, where the adjustable jaw 1306 is sized to fit around sides of the fastener 1502, the space between the jaws 1304, 1306 will return back to the original spacing to achieve the same fit. This movement and slipping feature of the first and second jaw inserts 1308, 1310 allows a user to operate the tool in a "ratcheting" manner.

Figure 15:
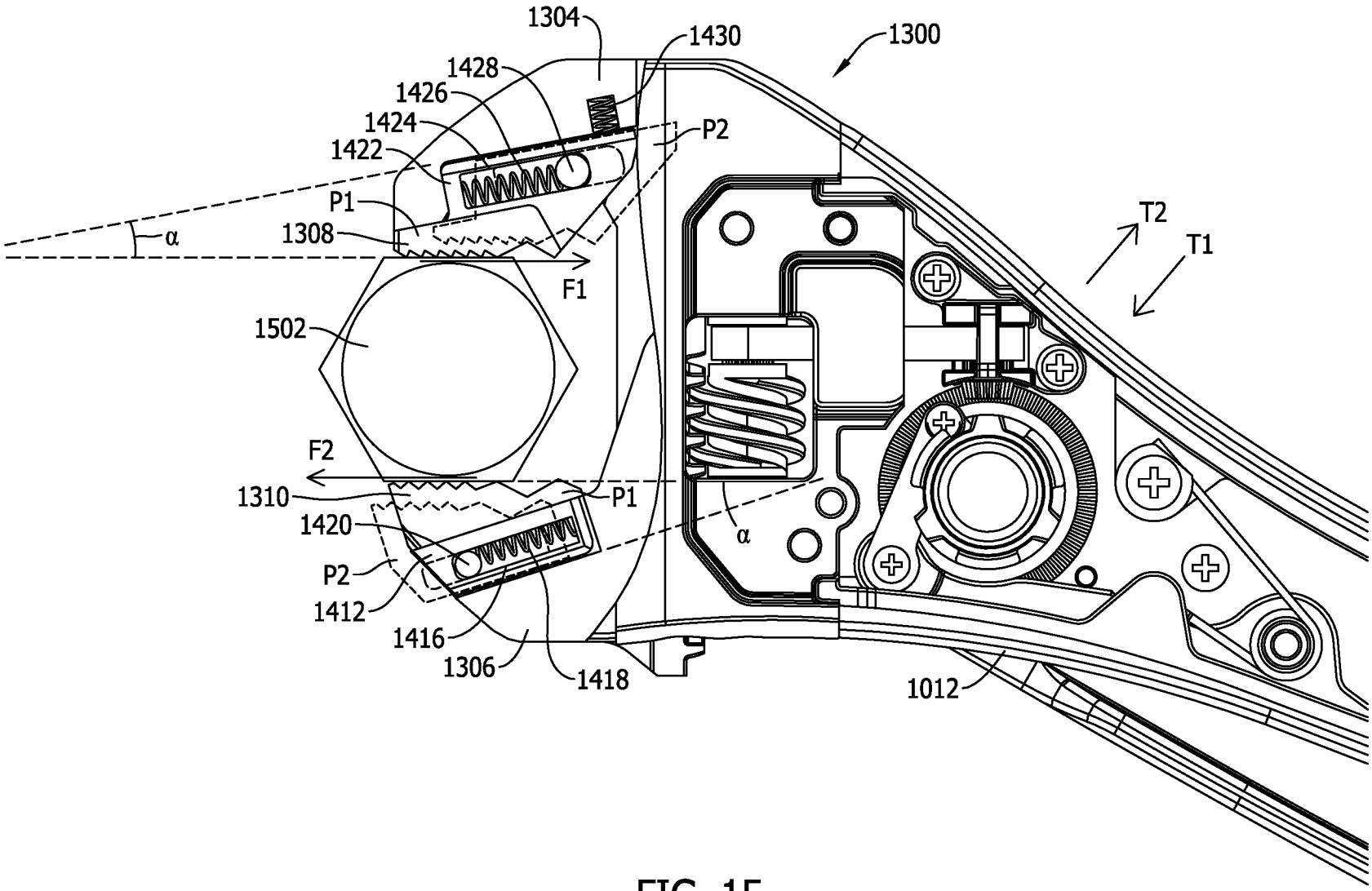
FIG. 15 illustrates operation of a tool in accordance with embodiments of the disclosure.

In particular, as illustrated in FIG. 15, because the first jaw insert 1308 is moving upwardly as it moves rearwardly (moving along the slot in the fixed jaw 1306, where that slot extends at an angle relative to the top of the fastener 1502), the distance between the first jaw insert 1308 and the second jaw insert 1310 at the location of the fastener 1502 increases, thus increasing the space between the fixed jaw 1304 and the adjustable jaw 1306. Likewise, because the second jaw insert 1310 is moving downwardly as it moves forward (moving along the slot 1416 in the adjustable jaw 1306, where that slot extends at an angle relative to the bottom of the fastener 1502), the distance between the second jaw insert 1310 and the first jaw insert 1308 at the location of the fastener 1502 increases. Ultimately, the distance between the first and second jaw inserts 1308, 1310 becomes sufficiently large at the location of the fastener 1502 that they can clear the corners of the sides of the fastener 1502 as the tool is rotated relative to the fastener 1502.

In the above-described configuration, the change in distance between the jaws 1304, 1306 is achieved by generally lateral movement of the first and second jaw inserts 1308, 1310 relative to the jaws (e.g. movement generally along the slots). It will be appreciated that the change in distance between the jaws at the location of the fastener may be achieved by having the first and second jaw inserts 1308, 1310 move along sloping slots and/or by the jaw inserts having a depth (from the teeth to the jaw to which it is mounted) which changes along the length of the jaw insert (whereby the "slope" of the jaw inserts themselves allows the distance between the jaws to change relative to one another at the location of the fastener). It is also possible for at least a portion of the change in distance between the jaws 1304, 1306 to result from movement of the first and second jaw inserts 1308, 1310 in and out relative to the jaws and fastener.

Of course, the tool 1300 might be used with fasteners other than 6-sided or hexagonal fasteners, such as four sided or square fasteners, eight sided or octagonal fasteners or the like.

In one embodiment, compression springs 1426, 1418 are used to bias the first and second jaw inserts 1308, 1310. Other means for biasing might be used, including resilient polymer inserts, other types of springs and the like. In some embodiments, the means for biasing might be positioned between a portion of the jaw insert 1308, 1310 and its respective jaw 1304, 1306, rather than in a recess or aperture in the jaw insert 1308, 1310.

Likewise, instead of a dowel or pin 1420, 1428, other types of stops might be provided for limiting the travel of the first and second jaw inserts 1308, 1310. Such stops might comprise, for example, flanges or the like which extend outwardly of the jaw inserts 1308, 1310 for contact with portions of the fixed and adjustable jaws 1304, 1306.

It is also possible for the first and second jaw inserts 1308, 1310 to be mounted for movement relative to the first and adjustable jaws 1304, 1306 in other manners. For example, instead of moving along slots, the jaw inserts 1308, 1310 might define slots that accept extensions of the fixed and adjustable jaws 1304, 1306 or the first and second jaw inserts 1308, 1310 might travel along slides, on a track, along a rail or the like.

As described, the tool 1300 includes a ratcheting-type mechanism which allows a user to apply a force to tighten a fastener when rotating the tool 1300 in a first direction (such as clockwise), but which allows the user to reposition the tool 1300 relative to the fastener without manually adjusting or changing a position of the jaws thereof, by simply rotating the tool 1300 in a reverse (counter-clockwise) direction. Of course, the tool 1300 might be configured so that the ratcheting-type mechanism is reversed, thus allowing a user to apply a force to loosen a fastener when rotating the tool 1300 in a first direction (such as counter-clockwise), but which allows the user to reposition the tool 1300 relative to the fastener without manually adjusting or changing a position of the jaws thereof, by simply rotating the tool 1300 in a reverse (clockwise) direction.

It is noted that in embodiments of the invention described herein the fixed jaw is described and illustrated as being located at a top of the tool head and the adjustable jaw is described and illustrated as being located at a bottom of the tool head. It will be appreciated that the positions of the fixed jaw and the adjustable jaw might be reversed.

In a preferred embodiment of the invention the ratcheting-type mechanism has been described relative to a tool which includes an adjustable wrench which includes a "squeeze" type jaw drive mechanism. The ratcheting-type mechanism might be applied to other types of tools which do not have such a mechanism, however, such as traditional adjustable wrenches (where the user moves the adjustable jaw by manual manipulation of a worm gear or the like), or other types of wrenches having open jaws, such as tongue and groove pliers (such as those marketed under the name Channellock), open end wrenches or the like.

In the above description, numerous details are set forth. It will be apparent, however, to one skilled in the art, that the present disclosure may be practiced without these specific details. In some instances, well-known structures and devices are shown in block diagram form, rather than in detail, to avoid obscuring the present disclosure.

It is to be understood that the above description is intended to be illustrative, and not restrictive. Many other embodiments may become apparent to those of skill in the art upon reading and understanding the above description. Although the present disclosure has been described with reference to specific embodiments, it should be recognized that the present disclosure is not limited to the embodiments described, but may be practiced with modification and/or alteration within the scope of the appended claims. Accordingly, the specification and drawings should be regarded in an illustrative sense rather than a restrictive sense. Moreover, the scope of the present disclosure should, thus, be determined with reference to the appended claims, along with the full scope of equivalents to which such claims are entitled.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An adjustable, ratcheting wrench comprising:
- a fixed jaw comprising a fixed jaw insert slot;
- a first jaw insert comprising:
  - a first flange disposed within the fixed jaw insert slot and configured to move within the fixed jaw insert slot,
  - a first elongated hole formed in the first flange of the first jaw insert, and
  - a first compression spring disposed in the first elongated hole;
- a first dowel disposed in the fixed jaw extending into the first elongated hole of the first flange, the first compression spring abutting against the first dowel to bias the first jaw insert in a first direction;
- an adjustable jaw comprising an adjustable jaw insert slot;
- a second jaw insert comprising:
  - a second flange disposed within the adjustable jaw insert slot and configured to move within the adjustable jaw insert slot,
  - a second elongated hole formed in the second flange of the second jaw insert, and
  - a second compression spring disposed in the second elongated hole;
- a second dowel disposed in the adjustable jaw extending into the second elongated hole of the second flange, the second compression spring abutting against the second dowel to bias the second jaw insert in a second direction opposite the first direction;
- a handle portion connected to the fixed jaw and the adjustable jaw, the handle portion comprising:
  - a grip,
  - a rocker arm extending from the grip,
  - a gearing mechanism disposed within the handle portion, the gearing mechanism being actuated by the rocker arm, and the gearing mechanism being linked to the adjustable jaw to move the adjustable jaw towards the fixed jaw, and
  - a push button configured to release the adjustable jaw from at least a portion of the gearing mechanism to allow the adjustable jaw to move away from the fixed jaw.

2. The wrench of claim 1, wherein a third direction defines the movement of the adjustable jaw towards and away from the fixed jaw and the first and second direction are oblique relative to the third direction.

3. The wrench of claim 2, wherein when the fixed and adjustable jaws are in contact with a fastener and the handle portion is torqued in a first rotational direction, the first dowel and the second dowel preventing the first jaw insert and the second jaw insert from moving thereby transferring torque to the fastener, and wherein when the fixed and adjustable jaws are in contact with the fastener and the handle portion is torqued in a second rotational direction opposite the first rotational direction, a reaction force from the fastener causes the first jaw insert and the second jaw insert to slide within the fixed jaw insert slot and the second jaw insert slot in the second direction and the first direction respectively, thereby allowing the fixed and adjustable jaws to slip over corners of the fasteners.

4. The wrench of claim 1, wherein the adjustable jaw comprises teeth and the gearing mechanism comprises a worm gear configured to drive the adjustable jaw via the teeth.

5. The wrench of claim 4, wherein the worm gear is connected to a pinion gear via a belt, the pinion gear is driven by center gear connected to a one-way clutch, and the one-way clutch is driven by the actuation of the rocker arm.

6. The wrench of claim 5, wherein the push button releases the center gear from the one-way clutch allowing a coil spring to drive the center gear, the adjustable jaw moving towards the fixed jaw when the center gear is connected to the one-way clutch, and the adjustable jaw moving away from the fixed jaw when the center gear is driven by the coil spring.

7. A ratcheting wrench comprising:
- a first jaw comprising:
  - a first jaw insert configured to move relative to the first jaw, and
  - a first spring configured to bias the first jaw insert in a first direction;
- a second jaw comprising:
  - a second jaw insert configured to move relative to the second jaw, and
  - a second spring configured to bias the second jaw insert in a second direction opposite the first direction, and a handle portion connected to the first jaw and the second jaw, the first direction being away from the handle portion and the second direction being toward the handle portion, wherein when the first jaw insert moves relative to the first jaw and the second jaw insert moves relative to the second jaw, a space between the first jaw and the second jaw increases.

8. The wrench of claim 7, wherein the first jaw is a fixed jaw, and the second jaw is an adjustable jaw that is configured to move towards and away from the fixed jaw.

9. The wrench of claim 8, further comprises a worm gear configured to drive the adjustable jaw towards and away from the fixed jaw.

10. The wrench of claim 7, wherein the first jaw comprises a first jaw insert slot, the first jaw insert comprises a first flange, and the first flange is disposed within the first jaw insert slot, and the second jaw comprises a second jaw insert slot, the second jaw insert comprises a second flange, and the second flange is disposed within the second jaw insert slot.

11. A ratcheting wrench comprising:

a first jaw comprising:

a first jaw insert configured to move relative to the first jaw, and a first spring configured to bias the first jaw insert in a first direction;

a second jaw comprising:

a second jaw insert configured to move relative to the second jaw, and a second spring configured to bias the second jaw insert in a second direction opposite the first direction, wherein when the first jaw insert moves relative to the first jaw and the second jaw insert moves relative to the second jaw, a space between the first jaw and the second jaw increases, the wrench further comprising a handle portion connected to the first jaw and the second jaw, the handle portion comprising:

a grip, a rocker arm extending from the grip, a gearing mechanism disposed within the handle portion, the gearing mechanism being actuated by the rocker arm, and the gearing mechanism being linked to the second jaw to move the second jaw towards the first jaw.

12. The wrench of claim 11, further comprising a push button configured to release the second jaw from at least a portion of the gearing mechanism to allow the second jaw to move away from the first jaw.

13. The wrench of claim 12, wherein the second jaw comprises teeth and the gearing mechanism comprises a worm gear configured to drive the second jaw via the teeth.

14. The wrench of claim 13, wherein the worm gear is connected to a pinion gear via a belt, the pinion gear is driven by center gear connected to a one-way clutch, and the one-way clutch is driven by the actuation of the rocker arm.

15. The wrench of claim 14, wherein the push button releases the center gear from the one-way clutch allowing a coil spring to drive the center gear, the second jaw moving towards the first jaw when the center gear is connected to the one-way clutch, and the second jaw moving away from the first jaw when the center gear is driven by the coil spring.

16. A ratcheting wrench comprising:

a first jaw comprising:

a first jaw insert configured to move relative to the first jaw, and a first spring configured to bias the first jaw insert in a first direction;

a second jaw comprising:

a second jaw insert configured to move relative to the second jaw, and a second spring configured to bias the second jaw insert in a second direction opposite the first direction, wherein when the first jaw insert moves relative to the first jaw and the second jaw insert moves relative to the second jaw, a space between the first jaw and the second jaw increases, wherein the first jaw comprises a first jaw insert slot, the first jaw insert comprises a first flange, and the first flange is disposed within the first jaw insert slot, and the second jaw comprises a second jaw insert slot, the second jaw insert comprises a second flange, and the second flange is disposed within the second jaw insert slot, wherein the first flange comprises a first elongated hole formed in the first flange of the first jaw insert, the first spring is a compression spring disposed within the first elongated hole, the second flange comprises a second elongated hole formed in the second flange of the second jaw insert, and the second spring is a compression spring disposed within the second elongated hole.

17. The wrench of claim 16, further comprising:

a first dowel disposed in the first jaw extending into the first elongated hole of the first flange, the first spring abutting against the first dowel to bias the first jaw insert in the first direction; and a second dowel disposed in the second jaw extending into the second elongated hole of the second flange, the second spring abutting against the second dowel to bias the second jaw insert in the second direction.

* * * * *